US011498016B1

(12) United States Patent
Cole

(10) Patent No.: US 11,498,016 B1
(45) Date of Patent: Nov. 15, 2022

(54) BOUNCY BOOK TOY

(71) Applicant: Bendon, Inc., Ashland, OH (US)

(72) Inventor: Jeffrey Charles Cole, Arvada, CO (US)

(73) Assignee: BENDON, INC, Ashland, OH (US)

( * ) Notice: Subject to any disclaimer, the term of this patent is extended or adjusted under 35 U.S.C. 154(b) by 288 days.

(21) Appl. No.: 16/735,886

(22) Filed: Jan. 7, 2020

Related U.S. Application Data

(60) Provisional application No. 62/791,347, filed on Jan. 11, 2019.

(51) Int. Cl.
*A63H 33/38* (2006.01)
*A63H 33/00* (2006.01)
*A63H 33/26* (2006.01)

(52) U.S. Cl.
CPC ..... *A63H 33/38* (2013.01); *A63H 33/003* (2013.01); *A63H 33/26* (2013.01)

(58) Field of Classification Search
CPC .... A63H 33/003; A63H 33/004; A63H 33/26; A63H 33/38
USPC ..... 446/147
See application file for complete search history.

(56) References Cited

U.S. PATENT DOCUMENTS 4,120,100 A * 10/1978 Dugan ..... B42D 1/003 248/174
4,597,743 A * 7/1986 Becker ..... A63H 33/38 281/15.1
4,819,963 A * 4/1989 Wolski ..... A63H 33/38 281/15.1
4,853,994 A * 8/1989 Ekstein ..... A47G 9/1045 5/639
4,978,141 A * 12/1990 Wu ..... A63H 33/38 281/15.1
5,653,470 A * 8/1997 Bennett ..... A63H 33/38 281/15.1
5,681,199 A * 10/1997 Morris ..... A63H 13/16 281/15.1
5,901,983 A * 5/1999 Bini ..... A63H 33/38 281/38
5,954,518 A * 9/1999 Teichberg ..... A63H 33/38 434/404
6,206,427 B1 * 3/2001 Kremer ..... A63H 33/38 281/15.1
6,247,730 B1 * 6/2001 Henderson ..... A63H 33/38 281/15.1

(Continued)

*Primary Examiner* — Joseph B Baldori
(74) *Attorney, Agent, or Firm* — Ralph E. Jocke; Walker & Jocke

(57) ABSTRACT

A child's toy transformable between a book position and a ball position, including a pair of end covers which each have round outer surfaces and planar inner cover surfaces, and a plurality of disc-shaped pages that have opposed circular planar surfaces with viewable indicia thereon. At least one flexible hinge in operative connection with each end cover and each page. In the ball position, the planar inner cover surfaces are in opposed facing relation and the plurality of disc-shaped pages are in abutting sandwiched relation therebetween. A releasable clasp may be engaged to hold the covers and pages in the ball position so the toy is readily rollable, and the clasp may be released to transform the toy to the book position in which the end covers are disposed away from one another and pages are individually movable to view indicia thereon.

32 Claims, 21 Drawing Sheets

(56) References Cited

U.S. PATENT DOCUMENTS

| | | | | |
|---|---|---|---|---|
| 6,364,360 | B1 * | 4/2002 | Kaufman | A63H 33/38 281/15.1 |
| 10,755,596 | B1 * | 8/2020 | Rudie | B42D 3/12 |
| 10,889,138 | B1 * | 1/2021 | Fry | B42D 1/008 |
| 11,000,775 | B1 * | 5/2021 | Riegelman | A63H 33/38 |
| 2001/0013698 | A1 * | 8/2001 | Soussan | A63H 33/38 281/15.1 |
| 2007/0102918 | A1 * | 5/2007 | Kaufman | A63H 33/38 281/15.1 |
| 2007/0252376 | A1 * | 11/2007 | Legrand | B42D 1/007 281/15.1 |
| 2009/0091116 | A1 * | 4/2009 | Legrand | A63H 33/38 281/15.1 |
| 2009/0102178 | A1 * | 4/2009 | Thompson | B42D 1/008 281/38 |
| 2015/0242185 | A1 * | 8/2015 | Stone | G06F 3/0446 345/174 |
| 2016/0063876 | A1 * | 3/2016 | Javidan | A63H 33/38 434/317 |
| 2017/0011650 | A1 * | 1/2017 | Simms | A63H 33/006 |
| 2021/0291575 | A1 * | 9/2021 | Rosebrough | A63H 17/00 |
| 2021/0300104 | A1 * | 9/2021 | Ost | A63H 3/10 |

* cited by examiner

BOUNCY BOOK TOY

TECHNICAL FIELD

Exemplary embodiments relate to children's toys. Exemplary embodiments include a children's toy that is a combination book and ball that is transformable therebetween.

BACKGROUND

Children's toys are designed to stimulate the child. Children's toys may be educational in nature. Children's toys are designed to grab and maintain the child's attention.

Children's toys may benefit from improvements.

SUMMARY OF THE DISCLOSURE

Exemplary embodiments relate to a child toy that is a combination book and ball. The exemplary embodiment is configured to be manually transformed by the child between a book and a ball. An exemplary embodiment has a pair of end covers that have round outer surfaces. In a ball configuration, a plurality of pages are sandwiched in parallel relation between the pair of end covers. The pair of end covers and the plurality of pages are operatively connected by at least one flexible hinge.

In an exemplary embodiment, the pair of end covers and the plurality of pages are movable in operative engagement with the at least one flexible hinge between an open position which corresponds to a book configuration and a closed position which corresponds to the ball configuration. In the open position, the pair of end covers are disposed away from one another a sufficient distance such that viewable indicia on the faces of the pages are individually viewable as pages of a book. In the closed position, the pages are in parallel sandwiched relation between the pair of end covers such that the pair of end covers and the plurality of pages define a ball that is rollable.

Further features of exemplary embodiments will be made apparent from the following Detailed Description.

DETAILED DESCRIPTION

Figure 1:
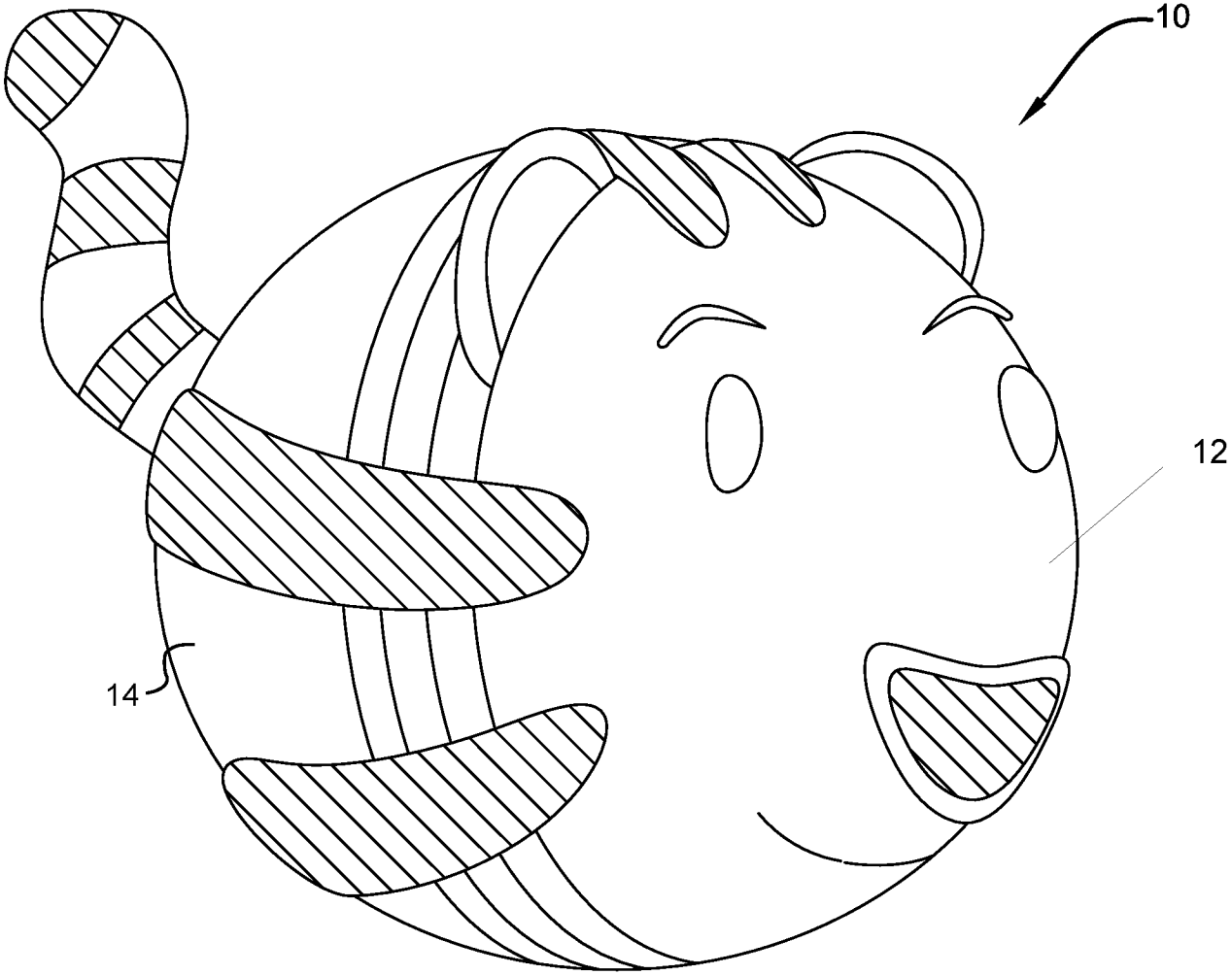
FIG. 1 is a front left side perspective view of an exemplary toy.

Referring now to the drawings and particularly to FIG. 1, there is shown an exemplary child toy 10. The exemplary toy 10 is configured to be in the shape of a ball when a pair of end covers 12 and 14 are in a closed position. The toy transforms into a book when the pair of end covers 12 and 14 are opened. When the pair of end covers 12 and 14 are closed and the toy 10 is in the shape of a ball as shown in FIG. 1, the toy 10 is round or almost round with a shape that is spherical or almost spherical. When in the shape of a ball, the exemplary toy 10 is rollable in any direction. The exemplary toy 10 may include appearance features, also referred to as outward extending projections 58, that tend to give the toy 10 a desired appearance. The exemplary appearance features in FIG. 1 tend to give the toy the appearance of a cat.

Figure 2:
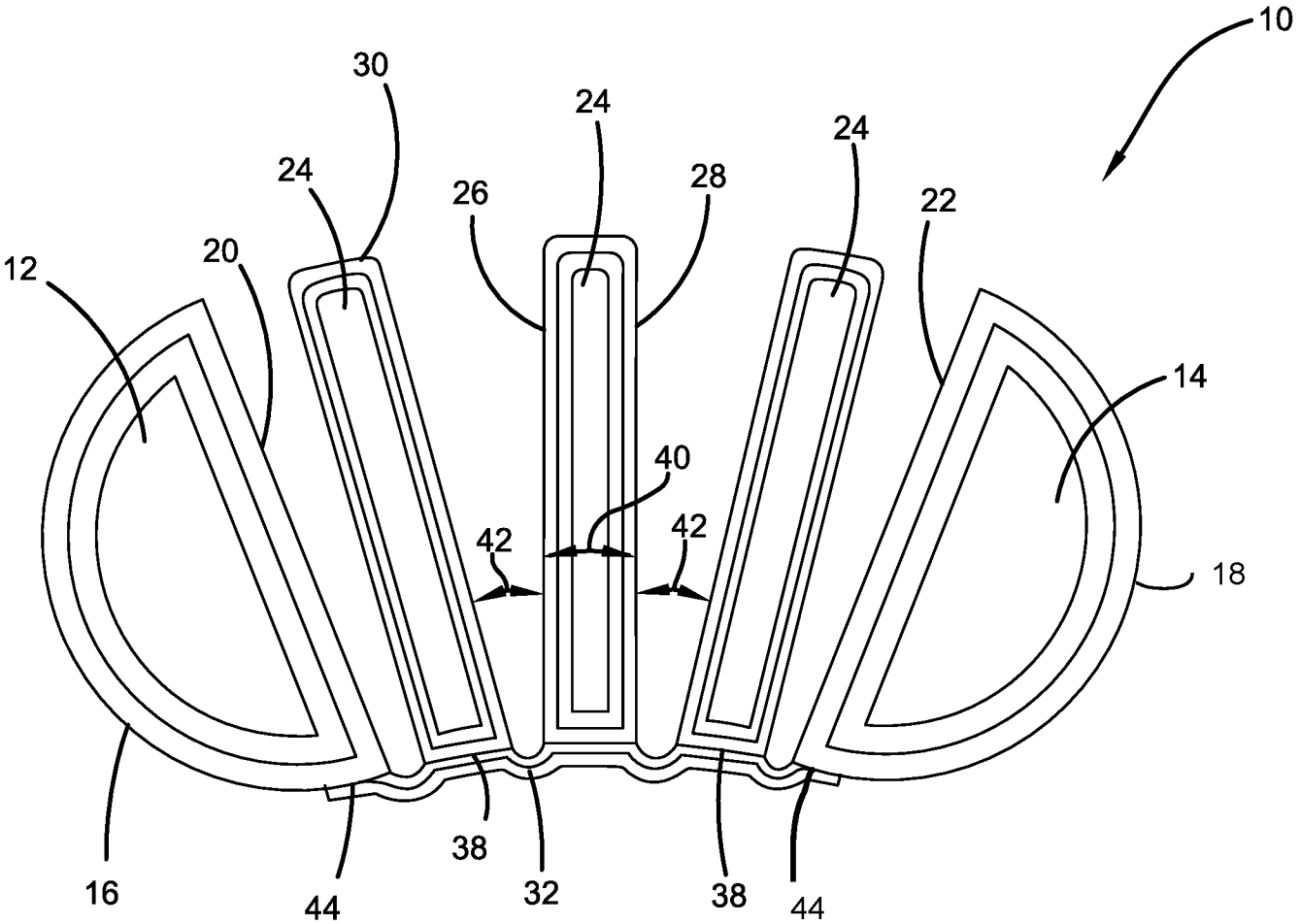
FIG. 2 is a top cross sectional view of an exemplary toy with the end covers in the book position.

As shown in FIG. 2, exemplary toy 10 includes the pair of end covers 12, 14. The pair of end covers 12, 14 may alternatively be referred to herein as hemispherical end covers. End covers 12, 14 are each generally a half of a ball that is round or almost round, with a shape that is spherical or almost spherical. In such exemplary embodiments, the end cover 12 has a round outer surface 16, and end cover 14 has a round outer surface 18. The end cover 12 has a planar inner surface 20, and the end cover 14 has a planar inner surface 22. As can be appreciated, in other embodiments, other end cover configurations may be used.

Figure 3:
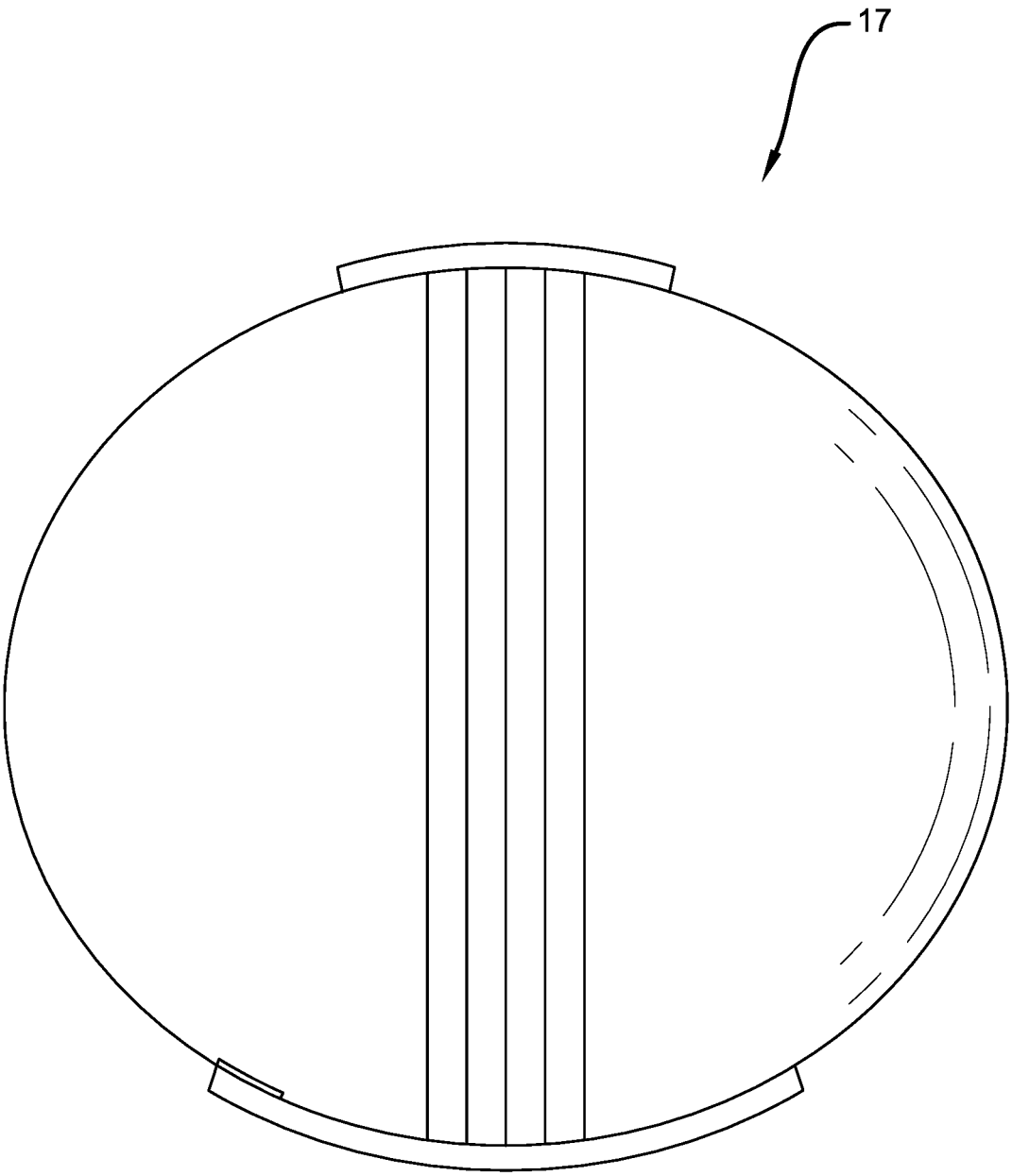
FIG. 3 is a bottom plan view of an alternative oblong shaped exemplary toy.
Figure 4:
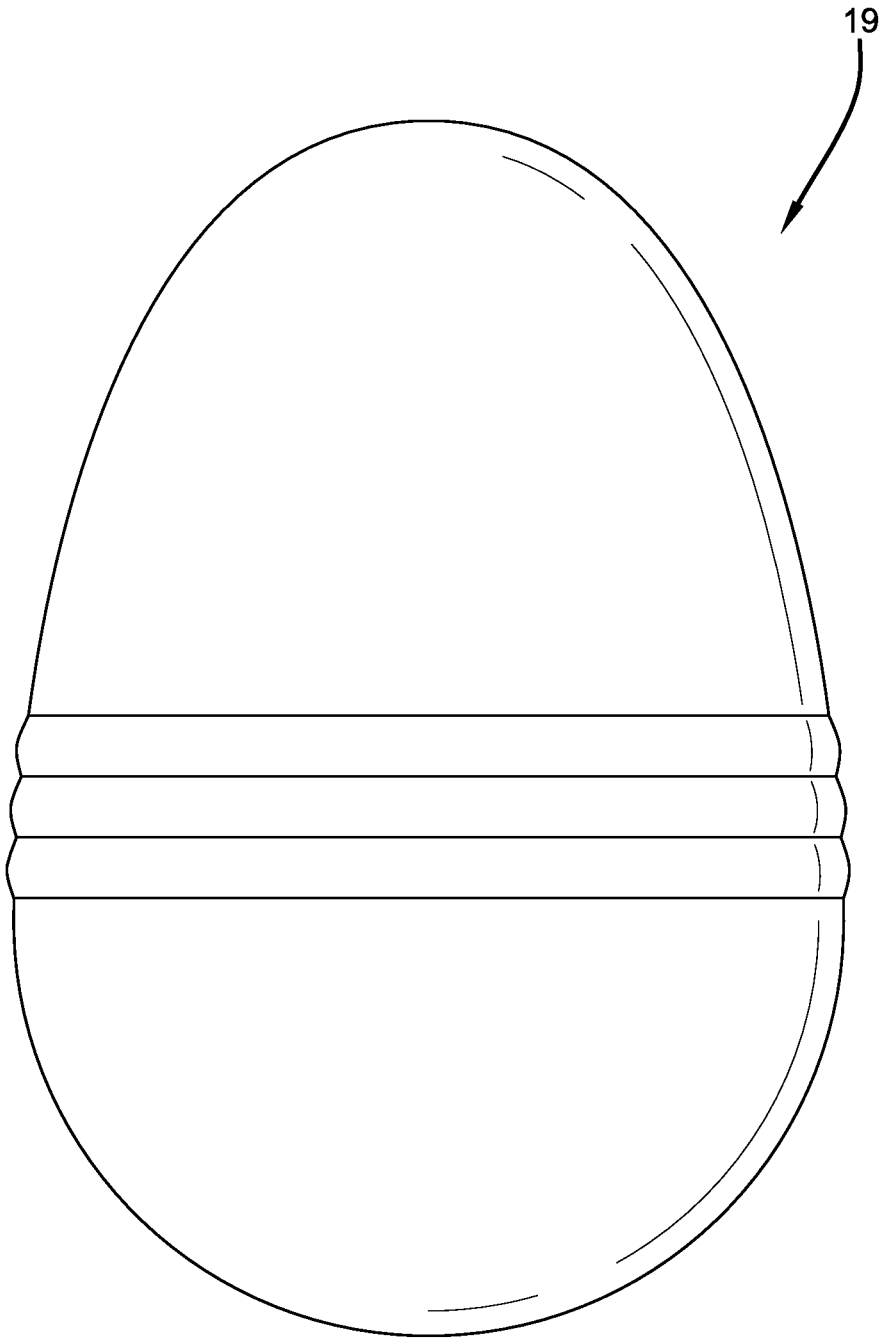
FIG. 4 is a front plan view of an alternative egg shaped exemplary toy.

As shown in FIG. 2, in exemplary embodiments, the pair of end covers 12, 14, their respective round outer surfaces 16, 18, and their respective planar inner surfaces 20, 22 may define halves of a sphere, a circle, or other shape of a generally round ball. For purposes of this disclosure, hemispherical means a portion of a sphere, and rounded means partially circular in transverse cross-section. In alternative exemplary embodiments, for example as shown in FIG. 3 and FIG. 4, the pair of end covers 12, 14, their respective round outer surfaces 16, 18, and their respective planar inner surfaces 20, 22 define halves of a three dimensional oblong shape 17 or an egg or three dimensional oval shape 19, as shown in FIG. 4. In other alternative embodiments, the toy 10 may be in the shape of a football, or any other relatively round or almost round three dimensional shape, spherical or almost spherical shape, or other three dimensional shape that is suitable to be used as a readily rollable toy.

The end covers 12, 14 may comprise various types of suitable material. For example, the end covers 12, 14 may comprise soft, plush, pliable material, formed round molded foam, foam encased in cloth, foam encased in a soft rubber or plastic material, a waterproof material, pliable plastic or fabric material, or any combination thereof. Of course, it should be understood that these configurations and materials are exemplary and in alternative embodiments, other materials and configurations may be used.

Figure 5A:
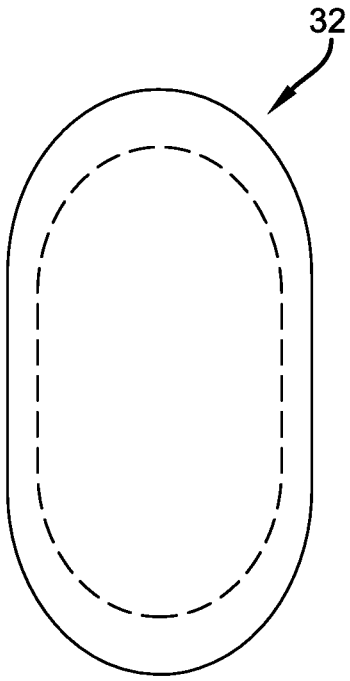
FIG. 5A is a top plan view of an exemplary hinge.
Figure 5B:
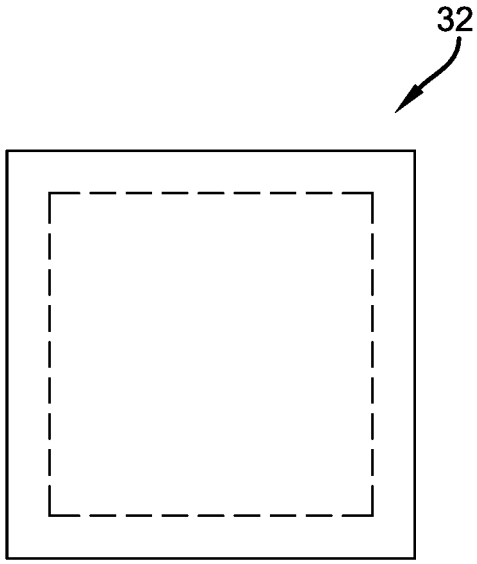
FIG. 5B is a top plan view of an alternative exemplary hinge.
Figure 5C:
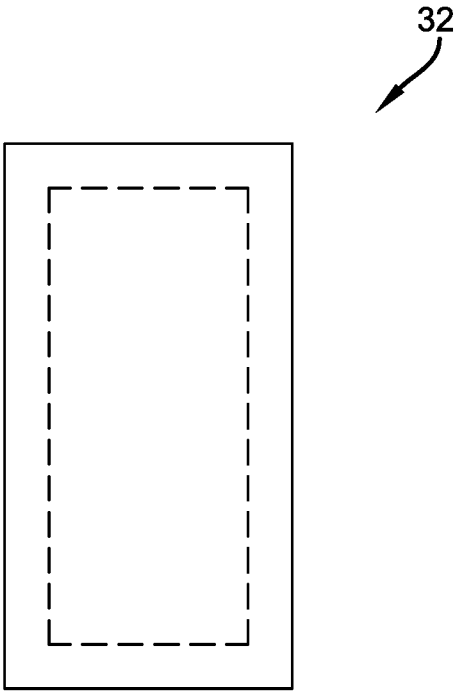
FIG. 5C is a top plan view of an alternative exemplary hinge.
Figure 5D:
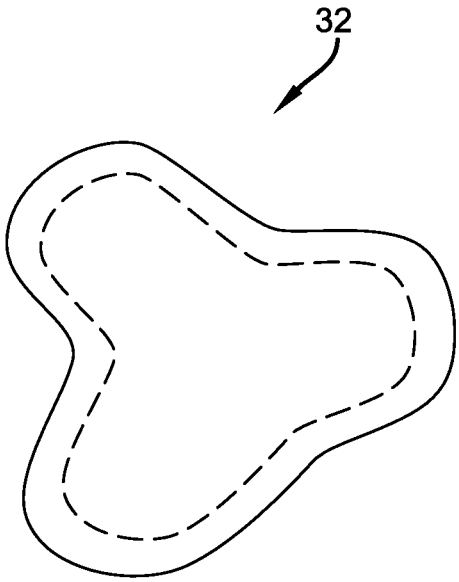
FIG. 5D is a top plan view of an alternative exemplary hinge.
Figure 6:
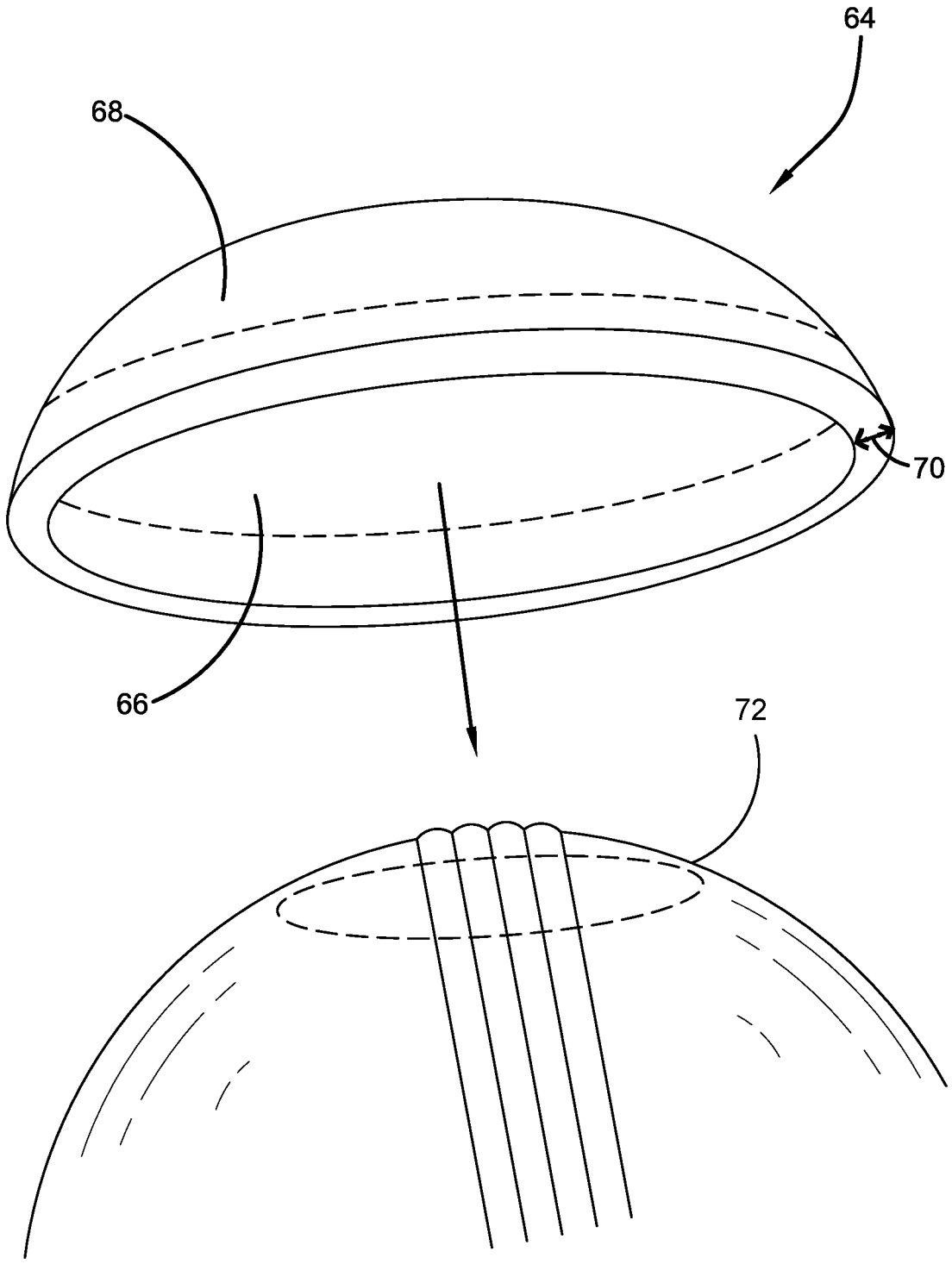
FIG. 6 is a partial exploded bottom side perspective view of an alternative exemplary meniscus shaped hinge showing a concave inner surface and a convex outer surface.

Referring again to FIG. 2, exemplary embodiments of the toy 10 include at least one flexible hinge 32. Hinge 32 is comprised of one or more pieces or strips of flexible material. Exemplary hinges may be comprised of durable flexible plastic, fabric or other material that can be flexed repeatedly without breaking. Alternative exemplary flexible hinge embodiments, as shown in FIG. 5, may comprise different shapes. For example, the flexible hinge 32 may comprise an oval shape as shown in FIG. 5A, a square shape as shown in FIG. 5B, a rectangle shape as shown in FIG. 5C, or an asymmetrical shape as shown in FIG. 5D. While the exemplary hinges are comprised of materials that have a generally continuous thickness in transverse cross-section, in other exemplary embodiments material with variable thickness may be used. The flexible hinges may have stitching represented by the dotted lines in FIGS. 5A-D, or the hinges may have pre-fabricated holes for stitching. In alternative exemplary embodiments, as shown in FIG. 6, a flexible hinge 64 may have a general shape of a circle or a meniscus. When the flexible hinge has a general shape of a circle or meniscus, it is referred to as a circular flexible hinge. In the undeformed condition, circular flexible hinge 64 has a concave inner peripheral surface 66 and a convex outer peripheral surface 68. Of course, these hinge configurations are exemplary and in other exemplary embodiments other hinge configurations and materials may be used.

Some exemplary embodiments of the flexible hinge 32 have a hinge thickness 70. The hinge thickness 70 extends the transverse distance between the disposed concave inner peripheral surface 66 and the convex outer peripheral surface 68 of the respective hinge.

In some exemplary embodiments, a plurality of flexible hinges may be utilized. The one or more hinges operatively attach together in relatively movable relation the end covers 12, 14 and the plurality of pages 24. The plurality of flexible hinges and the plurality of pages 24 of some exemplary embodiments will be described later in more detail.

The exemplary flexible hinges may be comprised of durable, generally flexible material. For example, some exemplary embodiments of the flexible hinge 32 may be made of cloth, foam, flexible plastic or flexible rubber, waterproof material, or any combination thereof. Of course, it should be understood that these configurations are exemplary and in other exemplary embodiments, other configurations and materials may be used.

Referring again to FIG. 2, in an exemplary arrangement, the pair of end covers 12, 14 are each operatively attached to a flexible hinge. The end covers include end cover points of attachment 44 on each of the round outer surfaces 16, 18 of the end covers. The pair of end covers 12, 14 are operatively connected to the flexible hinge 32 at the end cover points of attachment 44. The flexible hinge 32 operatively connects the pair of end covers 12, 14 in relatively movable connection.

In some exemplary embodiments, multiple flexible hinges 32 may be utilized to operatively connect the pair of end covers 12, 14. The end covers 12, 14 may be attached to the flexible hinges 32 by any number of different attachment methods. For example, the end covers 12, 14 may be attached to at least one flexible hinge 32 by fasteners such as clips, tabs, loops or stakes or by a fastening method such as sonic welding, fusion, sewing, stitching, or adhesive. However, it should be understood that these approaches are exemplary and in other exemplary embodiments, other attachment approaches may be used.

In some exemplary embodiments, as shown in FIG. 2, the toy 10 includes a plurality of disc-shape pages 24. Each disc-shape page of the plurality of disc-shape pages 24 has a first circular planar page surface 26 and an opposed second circular planar page surface 28. In exemplary embodiments, each disc-shape page has a circular peripheral surface 30 which bounds the diameter of the disc-shape page. The circular peripheral surface 30 extends transversely between the first circular planar page surface 26 and the second circular planar page surface 28 of the respective disc-shape page.

Figure 7:
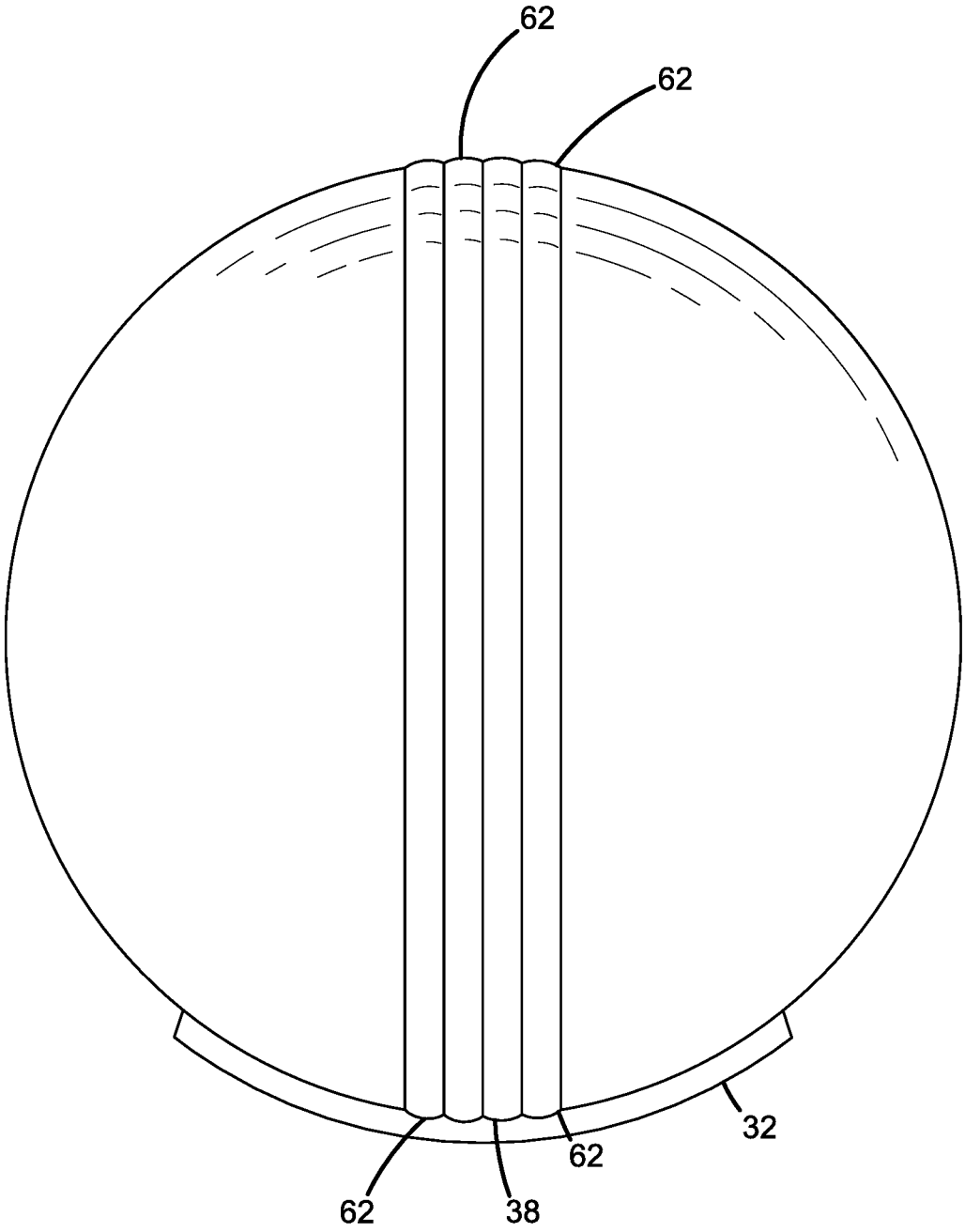
FIG. 7 is a top plan view of an exemplary toy showing the flexible hinge conforming to the round outer surface of the end covers and disc-shape pages.

In some embodiments, the circular peripheral surface of each of the pages may be of rounded contour as it extends between the first circular planar page surface 26 and the second circular planar page surface 28, as shown in FIG. 7. When the circular peripheral surface 62 is rounded, the circular peripheral surface may be referred to as a round peripheral surface of the disc-shape page. Of course, these arrangements are exemplary and in other embodiments, other arrangements may be used.

In alternative embodiments, the plurality of disc-shape pages 24 may comprise numerous different types of material. For example, as shown in FIG. 8 the plurality of disc-shape pages may be comprised of foam 74, foam encased in cloth, foam encased in a relatively flexible plastic or film, foam encased in rigid plastic, crinkle paper 75, a disc 76 encapsulated in clear flexible plastic, an electronic display screen 79 (for example an OLED display), a waterproof material, or combinations thereof.

Figure 8:
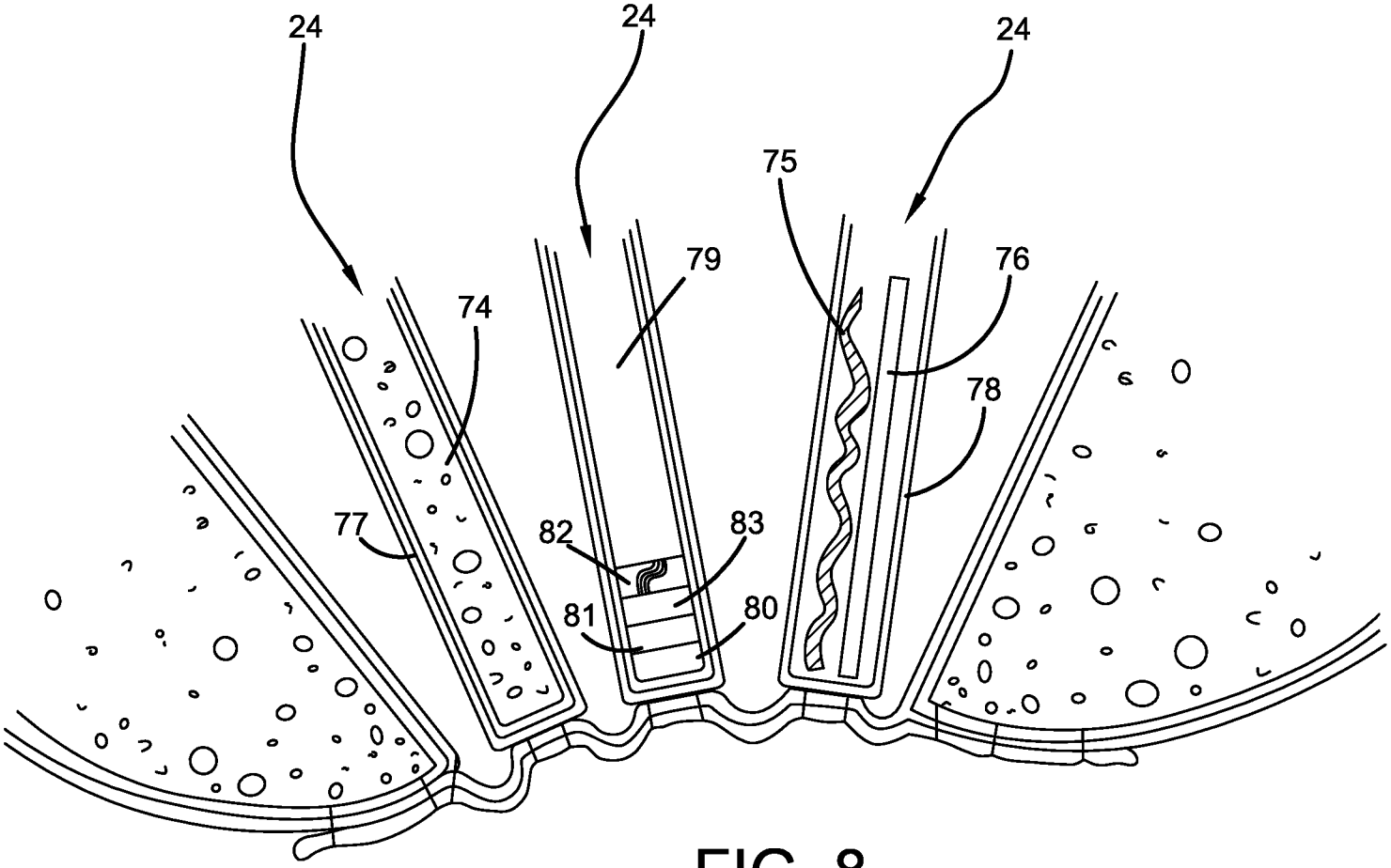
FIG. 8 is a top cross sectional view of an exemplary toy with the end covers in a book position showing the different compositions of the disc-shape pages.

In some embodiments, such as shown in FIG. 8, one or more of the plurality of disc-shape pages may be enclosed within dual outer protective layers 77, or a single outer protective layer 78. Such outer protective layers may be comprised of suitable materials. For example, dual outer protective layers 77 or single outer protective layer 78 may be comprised of flexible or rigid clear plastic, waterproof material, impact resistant or impact damping material, or combinations thereof. As can be appreciated, in other exemplary embodiments, other alternative page configurations and materials may be used.

Figure 9:
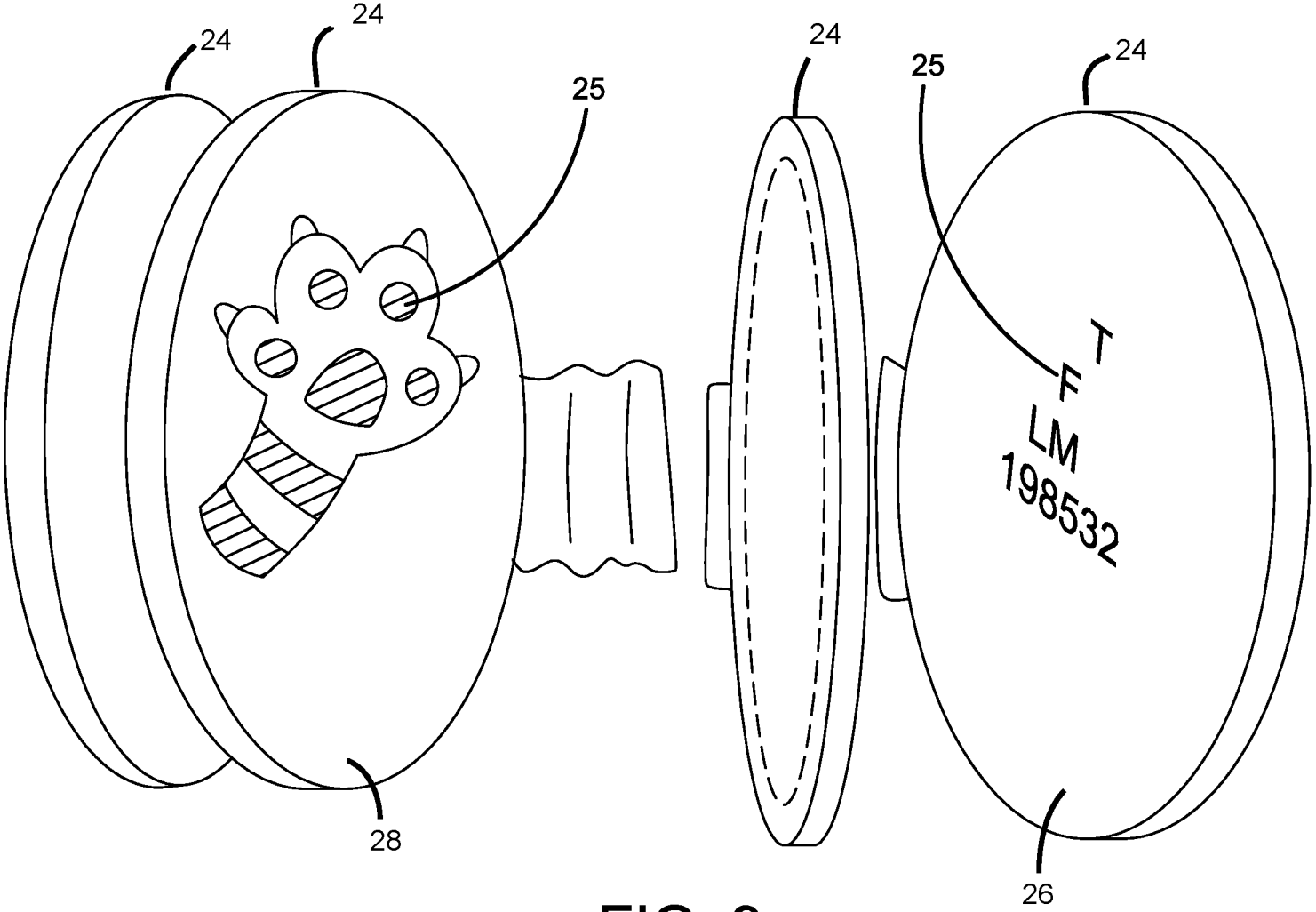
FIG. 9 is a partial perspective front view of exemplary disc-shape pages showing exemplary viewable indicia on the circular planar page surfaces.

As shown in FIG. 9, one or more of the exemplary disc-shape pages 24 may include exemplary viewable page indicia 25 on the first and second circular planar page surfaces 26, 28. In alternative embodiments, the crinkle paper 75, disc insert 76, screen 79, or the outer protective layers 77, 78 may contain the viewable indicia 25. Exemplary viewable page indicia 25 may comprise text, writing, numbers, pictures, graphics, or video displayed on screen 79. The exemplary viewable page indicia 25 may correspond to a common story, a common character, or an overall theme of the child toy 10.

In exemplary embodiments the planar inner surfaces 20, 22 of the pair of end covers 12, 14 may include viewable cover indicia 29. Viewable cover indicia 29 may comprise text, writing, numbers, pictures, graphics or other visible features. The cover indicia may be planar and flush with the surface or may be contoured and extend outward and/or inward to provide tactile stimulation. The exemplary viewable cover indicia 29 may correspond to a common story, a common character, or an overall theme of the child toy 10. Of course, it should be noted, that these configurations are exemplary and in other embodiments, other configurations may be used.

Figure 18:
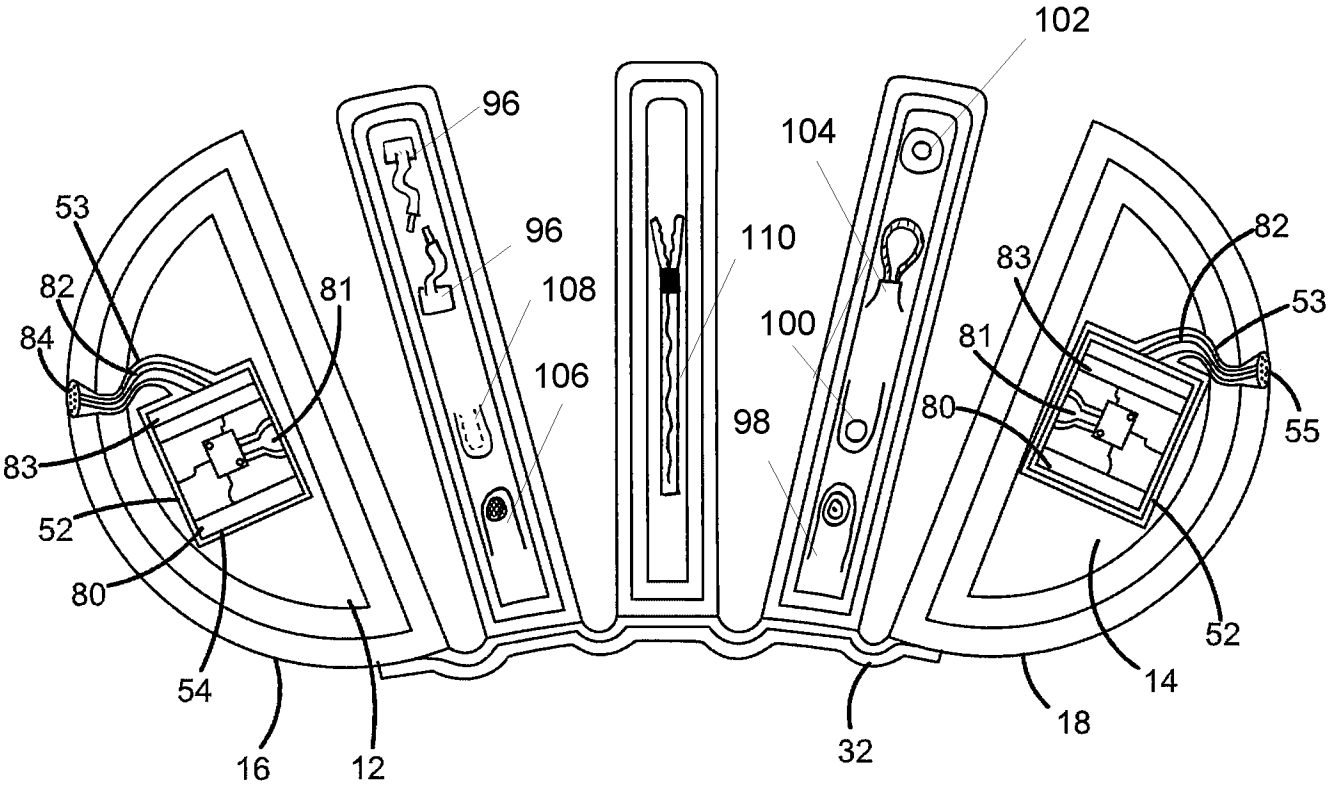
FIG. 18 is a top cross sectional view of the exemplary toy with end covers in a book position showing an exemplary: cavity; channel; noise maker; light; circuitry; wiring; memory; and rechargeable battery.

In some alternative embodiments, such as is shown in FIG. 18 the circular peripheral surface 30 or one of the circular planar page surfaces may include a zipper 110 or other fasteners such as a further pair of hook 106 and loop 108 structures, a further pair of tieable laces 96, a releasably engageable further first snap piece 98 and second snap piece 100, a further first piece including a button 102 and a further second piece including a hole 104 that enable access to an interior area of the respective disc-shape page. The zipper or other fasteners may be configured to enable access to an interior area of a disc-shaped page. Such access enables a user to switch out discs 76 or to access screen 79 within the disc-shape page. Such access may also permit a user of the child's toy to view content underneath one of the circular planar page surfaces. Such exemplary embodiments allows for the common story, common character, and overall theme to be changed or altered to correspond to an evolving story.

Referring again to FIG. 2, in some exemplary embodiments, each of the plurality of disc-shape pages 24 has a thickness 40. The thickness of each of the plurality of disc-shape pages 24 is the area transversely between the first and second circular planar page surfaces 26, 28. In some arrangements the thickness 40 may be consistent across each page, and the thickness may be the same for each of the plurality of disc-shape pages 24. In alternative exemplary embodiments, the thickness 40 may differ from disc-shape page to disc-shape page. Further in some arrangements the faces and/or the page indicia 25 may be contoured to include tactile shapes that correspond to the indicia thereon. However, these arrangements are exemplary and in other embodiments, other arrangements may be used.

As shown in FIG. 2 and FIG. 7, in some exemplary embodiments, each circular peripheral surface 30 or, as shown in some embodiments, round peripheral surface 62 of each of the plurality of disc-shape pages 24 is attached to a flexible hinge at a point of attachment 38. The point of attachment comprises the area of the respective peripheral surface at which the page is attached to a hinge by one of the suitable attachment methods. The point of attachment 38 on each peripheral surface 30 or round peripheral surface 62 is separated by a distance 42 from the point of attachment 38 of the immediately adjacent disc-shape page or end cover attachment point 44 of the immediately adjacent end cover 12 or 14. In exemplary arrangements, the distance 42 is greater than the thickness 40 of each of the plurality of disc-shape pages 24. In such exemplary arrangements, this configuration facilitates the ability to turn the pages and to view indicia on each circular planar page surface of the pages and on the planar inner surfaces of the end covers when the toy is in the book position. Of course, it should be noted that this configuration is exemplary and in other exemplary embodiments, other approaches and configurations may be used.

In alternative exemplary embodiments, a plurality of flexible hinges may be utilized to operatively connect the plurality of disc-shape pages 24 to one another and to operatively connect the plurality of disc-shape pages 24 to the end covers 12, 14. In such alternative exemplary embodiments, the hinges may extend in parallel relation to an axis of the exemplary toy 10 that extends centrally when the toy is in a ball position. In such exemplary arrangements the axis extends centrally through end cover 12, traverses the plurality of disc-shape pages 24, and extends centrally through end cover 14. In other exemplary arrangements a plurality of flexible hinges may be in staggered relation above, on, and below the axis across the backside of the toy 10 when in the ball position. In such alternative exemplary embodiments, each of the plurality of flexible hinges may be operatively connected to either a disc-shape page and one of the pair of end covers 12, 14 if the disc-shape page is immediately adjacent to an end cover, or the flexible hinge may be connected to a disc-shape page and an immediately adjacent disc-shape page if the disc-shape page is not immediately adjacent to an end cover. In other exemplary arrangements, each hinge may operatively connect a plurality of disc-shape pages, but less than all pages. In other arrangements, a hinge may be used to operatively connect a plurality of disc-shape pages, but less than all, to the one of the pair of end covers 12, 14. Numerous different hinge configurations and hinge structures may be used in exemplary arrangements.

In exemplary embodiments, each of the plurality of disc-shape pages 24 is operatively connected to at least one flexible hinge 32. Such pages may be attached by one or more different connection methods. For example, each of the plurality of disc-shape pages 24 may be operatively attached and/or connected to the flexible hinge 32 by a fastener or by heat fusion, sewing, stitching, or adhesive or other attachment methods. However, these attachment methods are exemplary and in other configurations, other approaches may be used.

Figure 10:
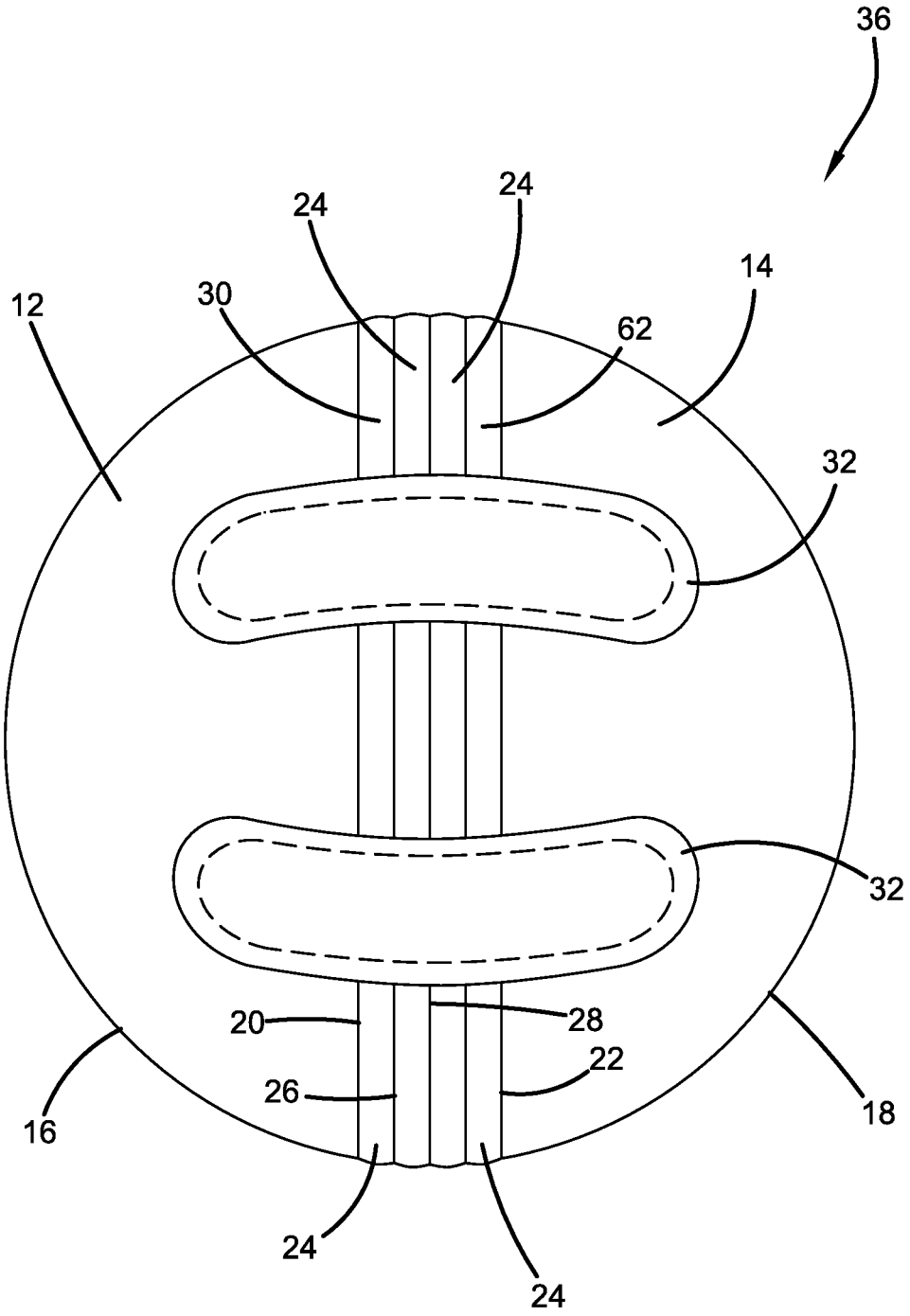
FIG. 10 is a backside plan view of an exemplary toy with end covers in a ball position and having an alternative exemplary dual hinge arrangement.
Figure 11:
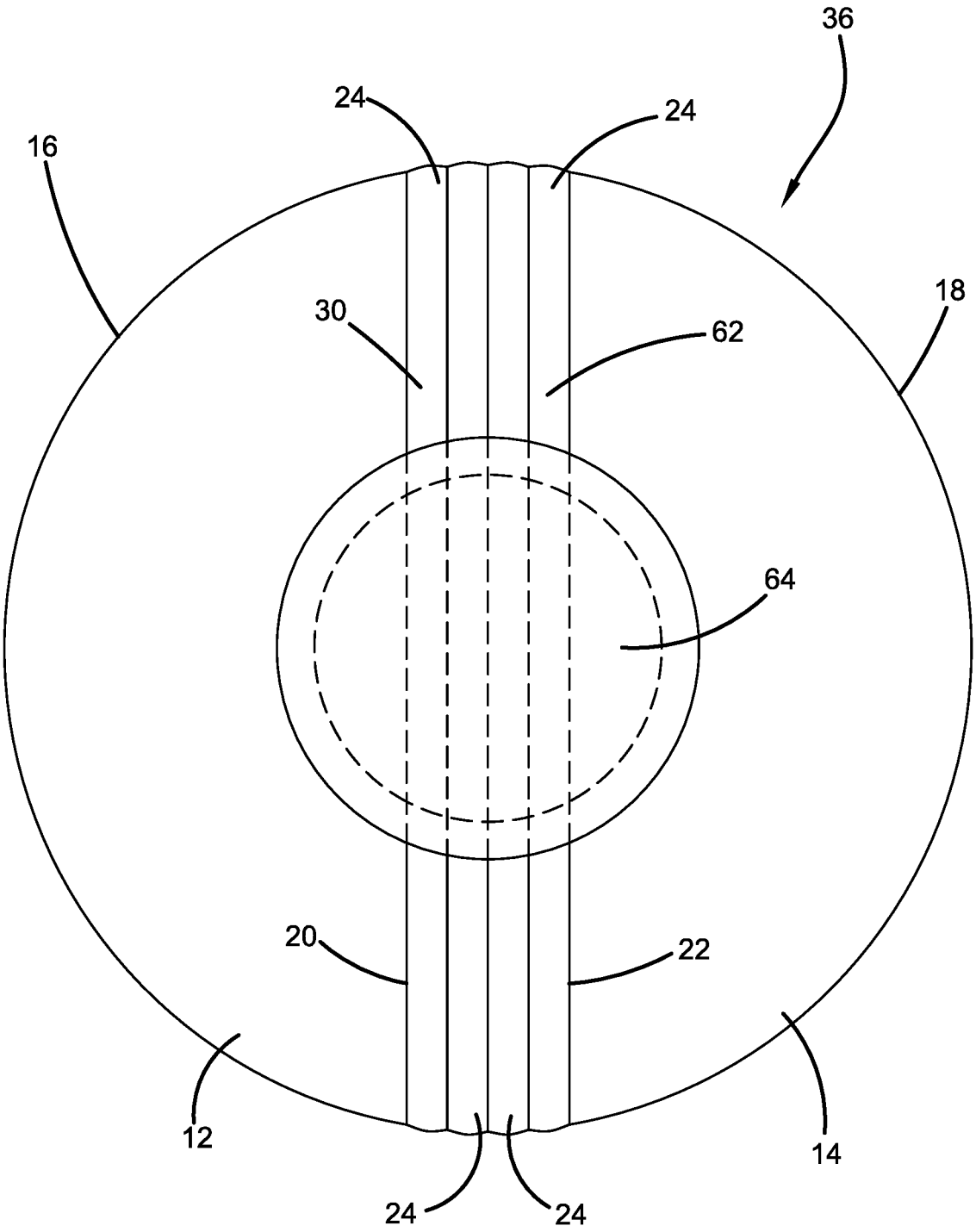
FIG. 11 is a backside plan view of an exemplary toy with end covers in a ball position having an alternative exemplary single circular hinge arrangement.

In exemplary embodiments, the end covers 12, 14 are movable in operative engagement with the at least one flexible hinge 32 such that the toy can be readily changed between a book position 34 and a ball position 36. When the pair of end covers 12, 14 are in the ball position 36, as shown in FIG. 10 and FIG. 11, the planar inner surfaces 20, 22 of each of the end covers 12, 14 are in opposed facing relation and the plurality of disc-shape pages 24 are in parallel abutting sandwiched relation between the planar inner surfaces 20, 22 of the end covers 12, 14.

Figure 12:
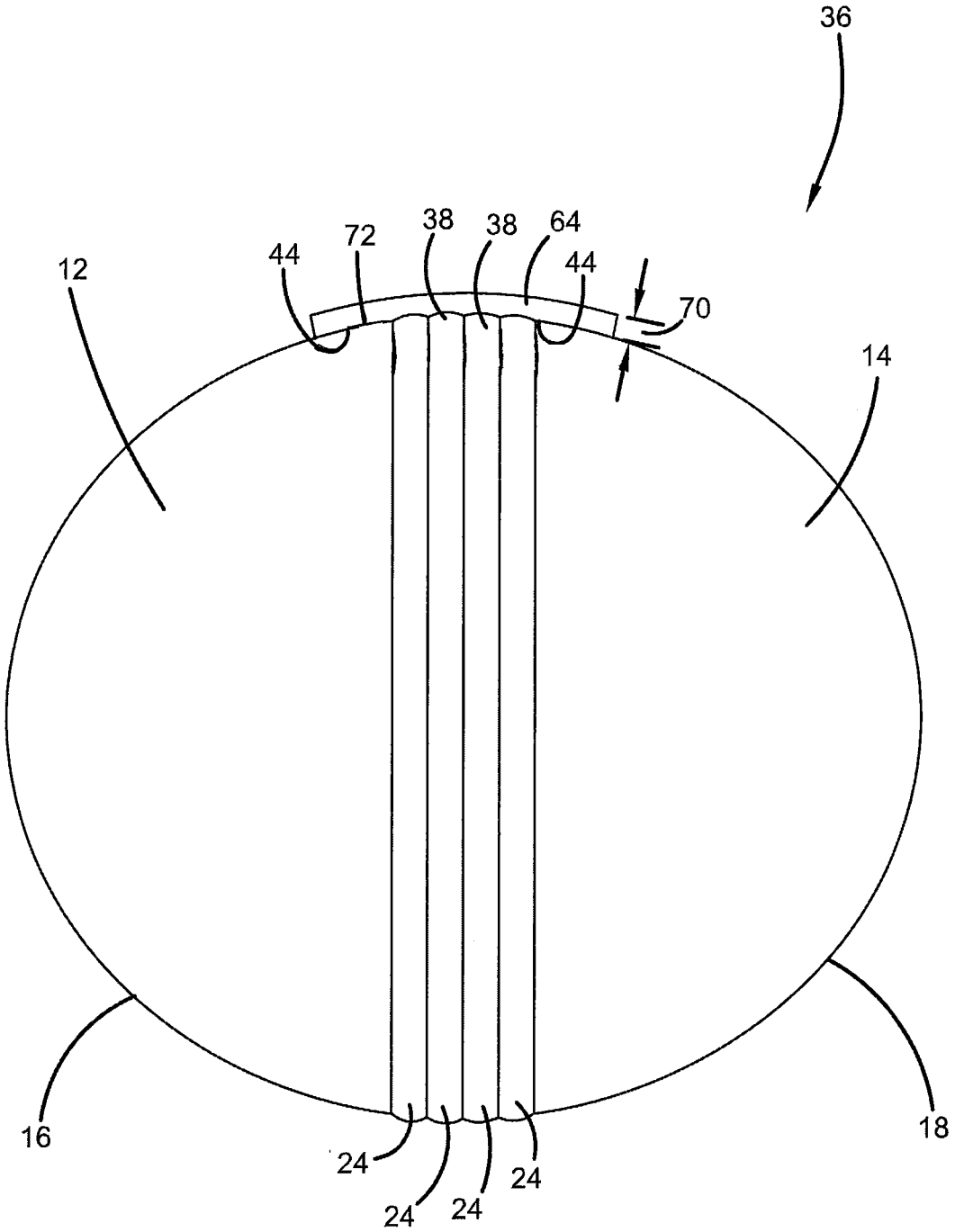
FIG. 12 is a bottom plan view of an exemplary toy with end covers in a ball position showing an alternative exemplary circular flexible hinge that conforms to the round outer surfaces of the end covers and the round peripheral surfaces of the plurality of disc-shape pages.

When the pair of end covers 12, 14 are in the exemplary ball position 36, as shown in FIG. 12, the circular flexible hinge 64 conforms to and overlies a convex outer peripheral surface 72. In the exemplary arrangement, the convex outer peripheral surface 72 is comprised of the round outer surfaces 16, 18 of each of the pair of end covers 12, 14 and the circular or round peripheral surfaces 30 and 62 of each of the plurality of disc-shape pages 24. The convex outer peripheral surface 72 of the exemplary embodiments is configured to be continuous such that the toy is enabled to be relatively easily rollable when toy is in the ball position. For purposes of this disclosure, continuous means a rounded surface with no gaps or only narrow gaps that do not impede rolling in the ball position between the pair of end covers in abutting relation with an immediately adjacent disc-shape page, and likewise no or only narrow gaps that do not impede rolling between immediately adjacent disc-shape pages that are in adjacent abutting relation in the ball position of the toy.

Figure 13A:
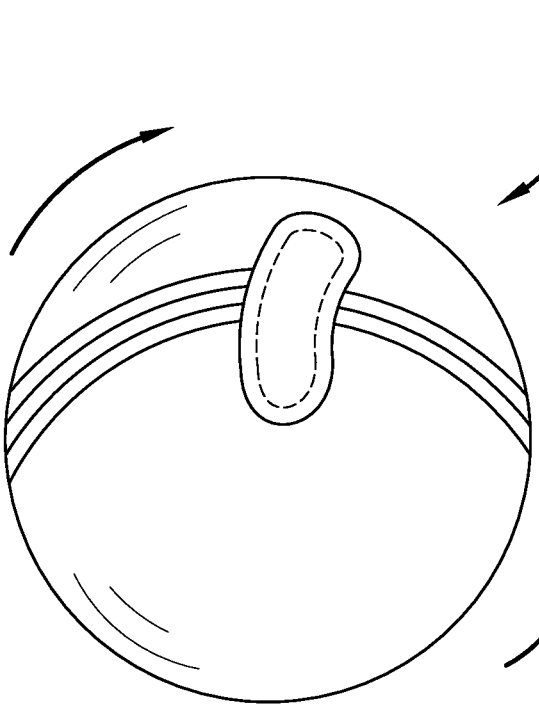
FIG. 13A is a perspective view of an exemplary toy in a first rotatable position.
Figure 13B:
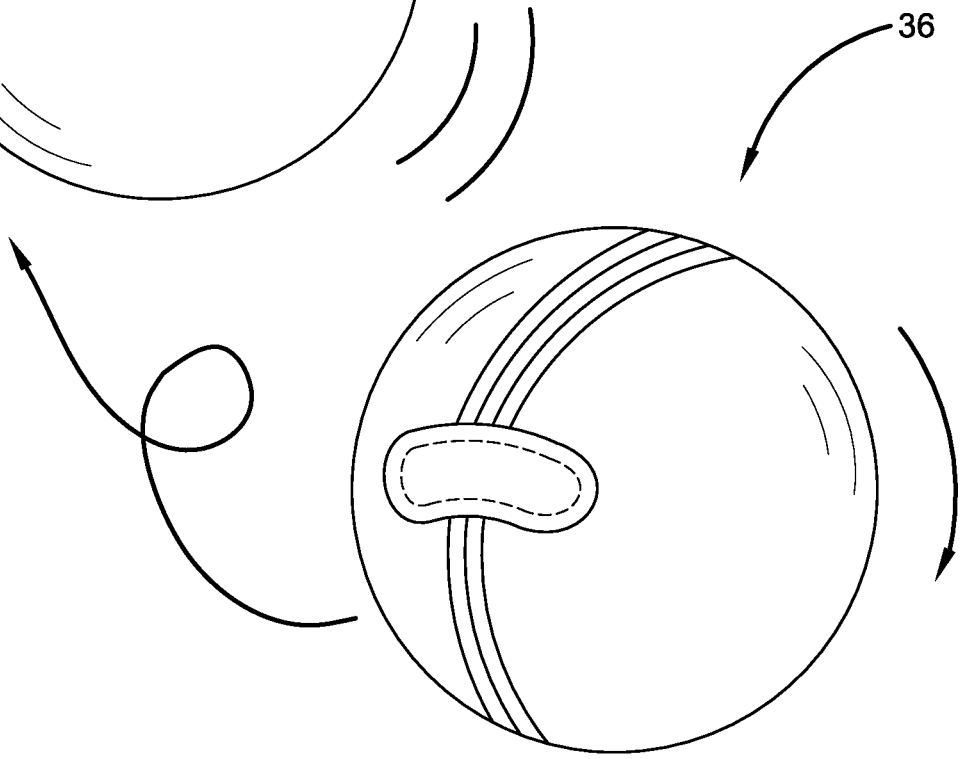
FIG. 13B is a perspective view of an exemplary toy in a second rotatable position.

Referring again to FIG. 12, in some exemplary embodiments, circular flexible hinge 64 extends the hinge thickness 70 outward from the round outer surfaces 16, 18 of the pair of end covers 12, 14. Therefore, in the ball position 36, as shown in FIGS. 13A and 13B, the toy 10 is rollable and is not hindered therefrom by the flexible hinge 32. However, it should be noted that this arrangement is exemplary and in other exemplary embodiments, other arrangements may be used.

Figure 14:
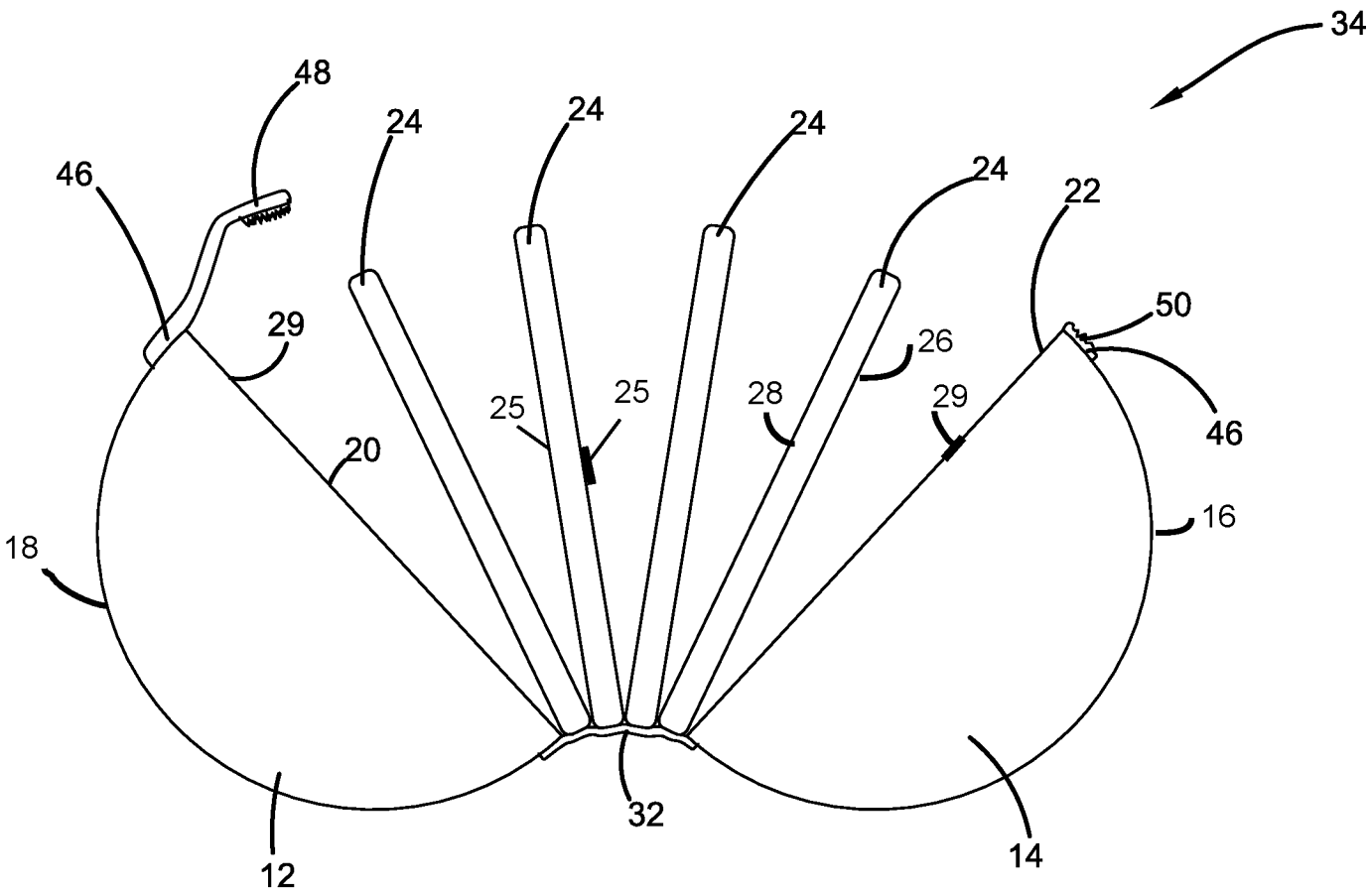
FIG. 14 is a top perspective view of the exemplary toy with end covers in a book position showing an exemplary releasable clasp in the unclasped position.

When the pair of end covers 12, 14 of the exemplary toy are in the book position 34 of some exemplary embodiments, as shown in FIG. 14, the planar inner surfaces 20, 22 of each of the end covers 12, 14 are further disposed from one another than when the toy is in the ball position 36. When the end covers 12, 14 are in the book position 34, the plurality of disc-shape pages 24 are each individually movable in engagement with the flexible hinge 32 such that the first and second circular planar page surfaces 26, 28 of each of the pages, and the viewable page indicia 25 and the viewable cover indicia 29 thereon are individually viewable.

Figure 15:
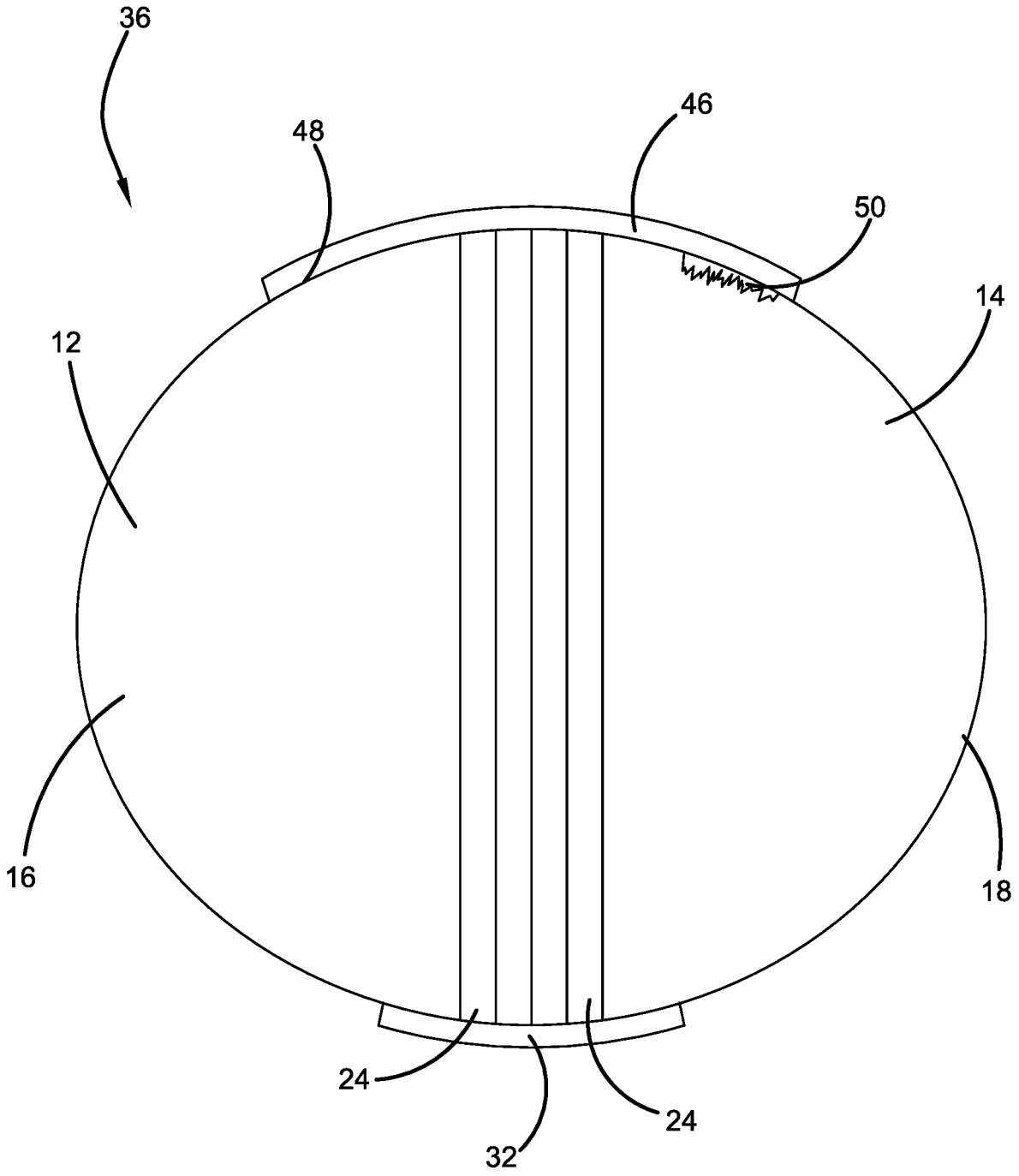
FIG. 15 is a top plan view of the exemplary toy with end covers in a ball position showing an exemplary releasable clasp in the clasped position and an alternative exemplary meniscus hinge conforming to round outer surfaces of exemplary end covers, the exemplary releasable clasp and the exemplary flexible hinge are in congruent relation on the front side and back side, respectively, of the exemplary toy.
Figure 16A:
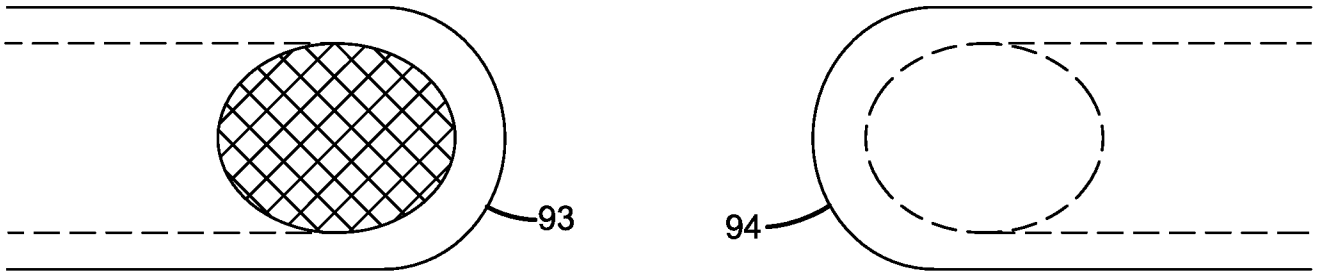
FIG. 16A is a perspective view of an exemplary clasp including a pair of hook and loop structures.
Figure 16B:
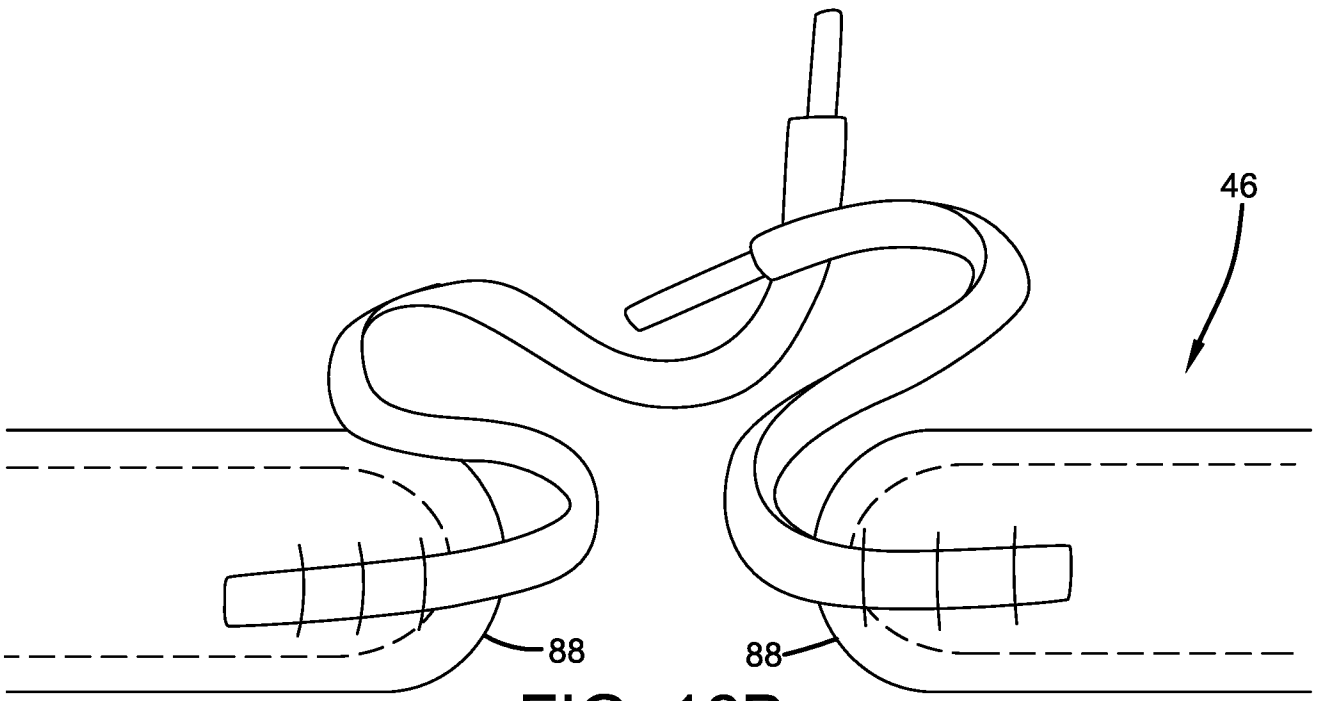
FIG. 16B is a perspective view of an exemplary clasp including an exemplary pair of tieable laces.
Figure 17A:
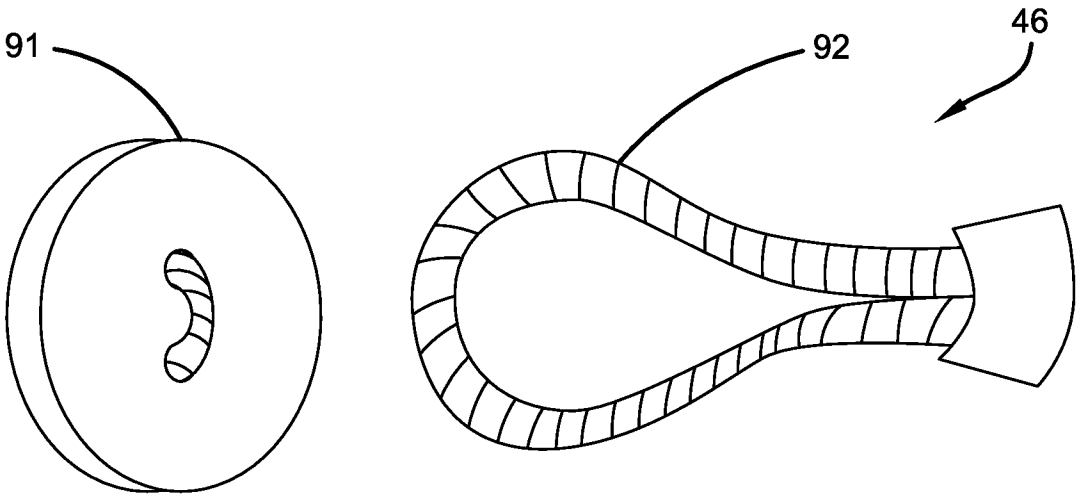
FIG. 17A is a perspective view of an exemplary clasp including a piece including a button and another exemplary piece including a hole.
Figure 17B:
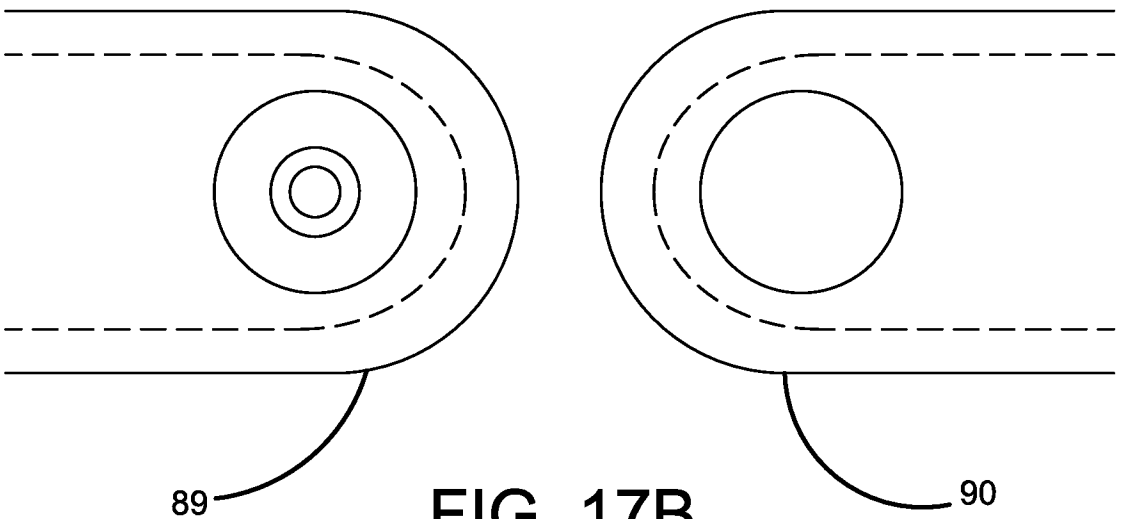
FIG. 17B is a perspective view of an exemplary clasp including an exemplary first snap piece and an exemplary second snap piece.

In exemplary embodiments, as shown in FIG. 14 and FIG. 15, the toy 10 includes a releasable clasp 46. The exemplary releasable clasp 46 includes a first piece 48 and a second piece 50. The first piece 48 is in operatively fixed attached connection with one of the round outer surfaces 16, 18 of the pair of end covers 12, 14. The second piece 50 is in operatively fixed attached connection with the other of the round outer surfaces 16, 18 to which the first piece 48 is not in operatively fixed attached connection.

The exemplary releasable clasp 46 is movable between an unclasped position as shown in FIG. 14, and a clasped position as shown in FIG. 15. In the unclasped position, the end covers 12, 14 are moveable to the book position 34 and the circular planar page surfaces 26 and 28, and inner planar surfaces 20 and 22 are separately viewable by manually turning of the pages 24. In the clasped position, the end covers 12, 14 and the pages are held in the ball position 36.

In some alternative exemplary embodiments, the releasable clasp 46 is comprised of one piece that is in operatively fixed attached connection with one of the pair of end covers 12, 14. The exemplary alternative one piece clasp is configured to engage the other of the pair of end covers to hold the toy 10 in the ball position. When the exemplary alternative one piece clasp engages the other of the pair of end covers, the end covers 12, 14 and the pages are held in the ball position 36.

The exemplary first and second pieces 48, 50 of the releasable clasp may comprise numerous different types of clasp. For example, as shown in FIGS. 16A and 16B and FIGS. 17A and 17B, the exemplary first and second pieces 48, 50 of the releasable clasp may comprise a pair of hook 93 and loop 94 structures such as Velcro® material, a pair of tieable laces 88, a first snap piece 89 and a second releasable snap piece 90, or a piece including a button 91 and another piece including a hole 92. In alternative exemplary embodiments, the first and second pieces 48, 50 of the releasable clasp 46 may comprise a pair of attracting magnets. Of course, these arrangements are exemplary and in other exemplary embodiments, other arrangements may be used.

The exemplary first and second pieces 48, 50 of the releasable clasp 46 may be in fixed operatively attached connection with the round outer surfaces 16, 18 of the end covers 12, 14 by suitable attachment means. For example, the first and second pieces 48, 50 of the releasable clasp 46 may be attached to the round outer surfaces 16, 18 by a fastener or by sonic welding, heat fusion, sewing, stitching, or adhesive.

The first and second pieces 48, 50 of the releasable clasp 46 may be made of any suitable material. For example, the first and second pieces 48, 50 of the releasable clasp 46 may be made of rubber, plastic, metal, wood, cloth, lace, string, waterproof material, magnetic material, or combinations thereof. However, it should be understood that these embodiments are merely exemplary and in other exemplary embodiments other materials and configurations may be used without departing from the teachings herein.

Figure 19:
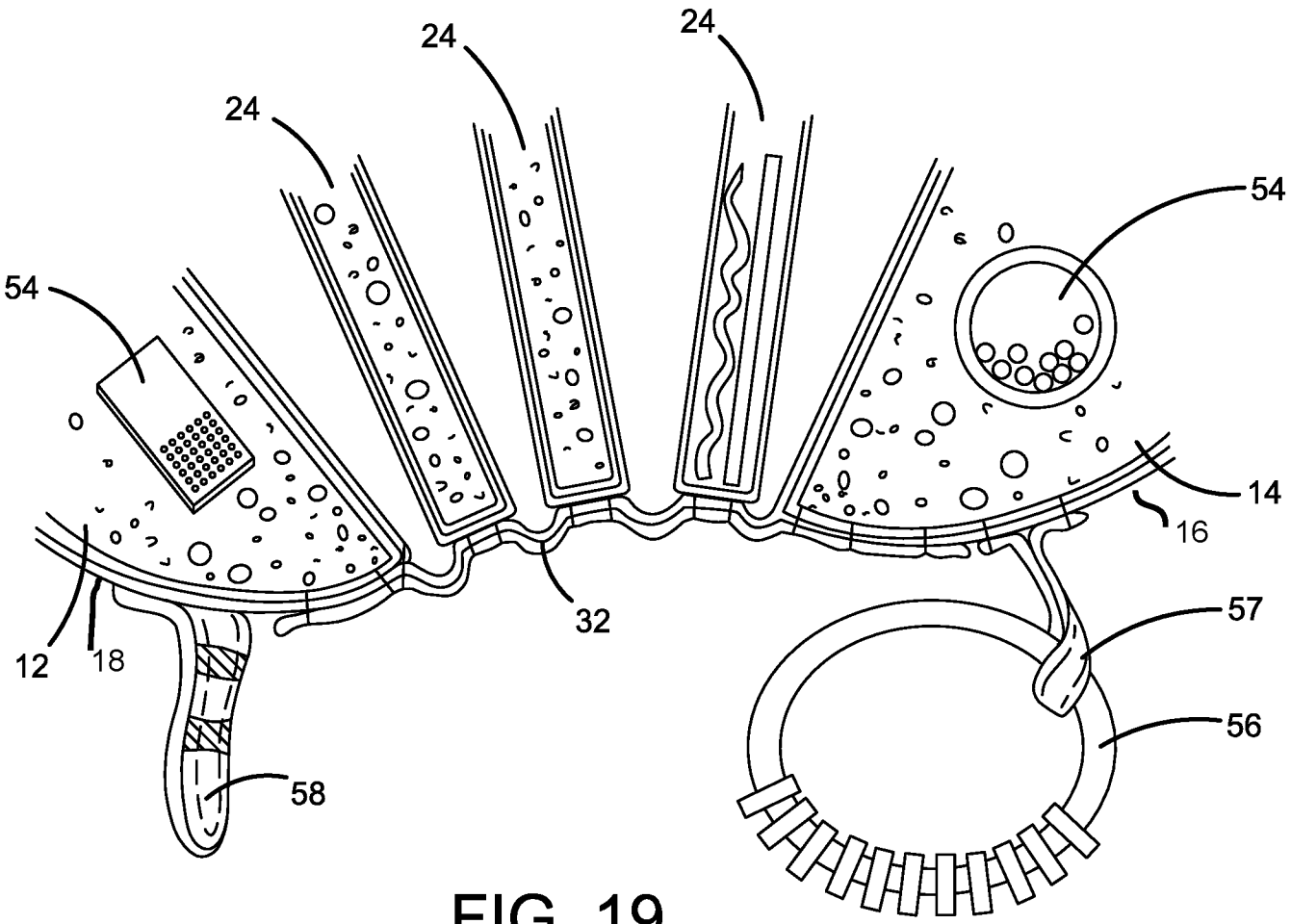
FIG. 19 is a partial top cross sectional view of the exemplary toy with end covers in a book position showing an exemplary teething ring and an exemplary noise maker.

In alternative exemplary embodiments shown in FIGS. 18 and 19, at least one of the pair of end covers 12, 14 may include a cavity 52 that includes an interior. The cavity interior may be configured to house a noise maker 54. Noise maker 54 may include an electronic noise maker. Alternatively, noise maker 54 may include a non-electronic noise-maker such as a rattle or any other non-electronic noise maker suitable for use by an infant or child. Other examples of noise makers include a horn and bellows or an electronic buzzer or emitter that emits a selected sound. For example, if in the ball position the ball end covers include features that look like an animal, the sound emitter may output sounds like that made by the animal. If the noise maker 54 is a horn and bellows, when the respective end cover with the noise maker is squeezed the bellows are compressed pushing air through the horn and producing a horn noise. If noise maker 54 is a buzzer or other type sound emitter, the toy may include a switch so that when the respective end cover with the buzzer is squeezed, the buzzer produces a buzzer or other noise emitter. Of course, these noise makers are exemplary and in alternative exemplary embodiments, other configurations or noise emitters may be used.

In alternative exemplary embodiments, as shown in FIG. 19, one of the pair of end covers 12, 14 may have a teething ring 56 for infants operatively attached to the round outer surface 16, 18 of one of the pair of end covers 12, 14. An exemplary teething ring 56 may be made of any suitable material. For example, an exemplary teething ring 56 may be flexible plastic or rubber and be of a size such that the infant cannot choke on the teething ring.

Exemplary teething ring 56 may be attached or tethered to the round outer surface 16, 18 of one of the pair of end covers 12, 14 by any suitable attachment means. For example, a cloth piece 57 may be attached to the round outer surface 16, 18 by a fastener or by sewing, stitching, ultrasonic welding, fusion or adhesive to the round outer surface 16, 18. Exemplary cloth piece 57 is looped around or otherwise secured to the teething ring 56. In alternative exemplary embodiments, as shown in FIG. 19, exemplary cloth piece 57 extends in looped around relation of the teething ring 56. In alternative exemplary embodiments, cloth piece 57 may be a piece comprised of rubber, flexible plastic, or any other type of suitable material. Of course, this arrangement is exemplary and in alternative exemplary embodiments, other approaches may be used.

Figure 20:
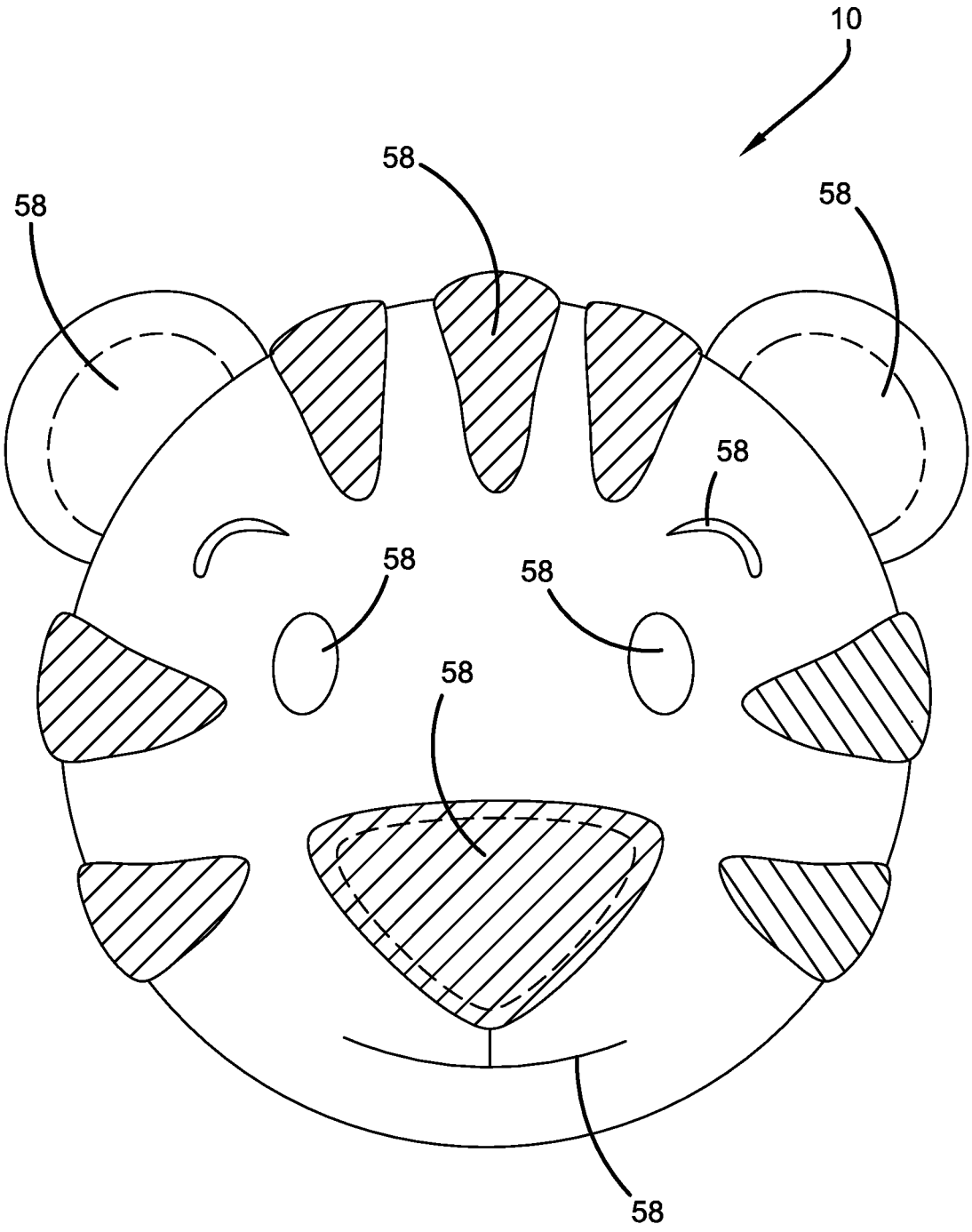
FIG. 20 is a front view of an exemplary toy showing the outward extending projections giving the exemplary toy an appearance of a cat.

Referring now to FIG. 20, in alternative exemplary embodiments the pair of end covers 12, 14 may include outward extending projections 58 projecting from the outer surfaces thereof. Exemplary outward extending projections 58 may give the toy 10 features of any desired appearance. For example, the exemplary outward extending projections 58 may give the toy 10 one or more appearance features of an animal, a human, or a particular type of sports ball or other object. In alternative exemplary embodiments, the outward extending projections 58 may correspond to the common story, the common character, or the overall theme of the toy 10. However, it should be understood that this approach is exemplary and in alternative exemplary embodiments other approaches may be used without departing from the teachings hereof.

In alternative exemplary embodiments, the child toy 10 is comprised of material that is generally impenetrable by water or other liquids so that the toy is waterproof. In alternative exemplary embodiments, the child toy 10 may be of suitable materials so that it is buoyant so that the toy 10 may be used in pools, bath tubs, rivers, lakes, and oceans without sinking.

Referring again to FIG. 8, in alternative embodiments, the plurality of disc-shape pages may contain a display screen 79. For example, screen 79 may be an OLED or LCD screen. Screen 79 may be configured to display data, still pictures, a motion picture, or video that corresponds to a common story, common character, or an overall theme of the toy 10. In exemplary arrangements screen 79 may be encased in flexible or rigid plastic, waterproof material, or any combination thereof. In some embodiments, screen 79 may be encased in impact resistant or impact damping material. In exemplary arrangements Screen 79 is in operative connection with a rechargeable battery 80, circuitry 81 that includes a memory 83, wiring 82. Memory 83 stores data corresponding to the output graphic display material that corresponds with the common story, the common character, or the overall theme of the toy 10.

In some exemplary embodiments, the plurality of disc-shape pages may include motion sensors that trigger the video or other visible indicia to be displayed on screen 79. The motion sensors may be in wired or wireless communication with the circuitry 81. For example, screen 79 may begin to display indicia such as video when the respective disc-shape page that includes screen 79 has been turned a sufficient distance or is sensed as in an orientation such that the entire circular planar page surface 26, 28 is viewable.

In alternative exemplary embodiments, the common story or character may be continually evolving, such as through an iterative series of audio and/or graphic outputs which make up developing story line. In such exemplary embodiments, it is possible to load new data that corresponds to graphic or other outputs that corresponds to the evolving story. Therefore, the exemplary circuitry 81 may include a wireless transmitter and receiver that is operative to enable the circuitry to receive new data. Circuitry 81 and memory 83 may be accessed through a wireless network by another local computing device operated by a parent or custodian of the child, that has a transmitter and receiver such as a mobile phone, electronic tablet, or computer. The other local computing device may be able to access an Internet marketplace such as an app store through a local wireless network and download selected new data to provide new outputs from the toy. The other local device may be able to send the downloaded data through a local wireless network or by other local wireless communication to circuitry 81. The downloaded data may be stored on the memory 83. The memory 83 may be accessed by the other local device to add, remove, or overwrite data on the memory. The downloadable data may correspond to the common story, the common character, or the overall theme of the toy 10.

In alternative exemplary embodiments, the cavity 52 may include a channel 53 that extends to the round outer surface 16, 18 of the respective end cover 12, 14. The cavity may include an electronic noise maker 54. The noise maker 54 may comprise a speaker 84, a rechargeable battery 80, circuitry 81 that includes a memory 83, and wiring 82. Wiring 82 may be operatively connected to the rechargeable battery 80, and circuitry 81 that includes the memory 83 in the cavity interior and extend from the cavity 52 through the channel 53 to a speaker 84 on the round outer surface 16, 18 of the respective end cover 12, 14. Memory 83 may store data corresponding to a common story, a common character, or an overall theme of the toy 10. Further in some exemplary arrangements the toy may output coordinated visual outputs through the screen and audible outputs from the speaker responsive to the stored data.

In some exemplary embodiments, the plurality of disc-shape pages may include motion or orientation sensors that trigger the audio to be output from the speaker 84. The motion sensors may be in wireless communication with circuitry 81 to output the audio from the speaker 84 at an appropriate time. For example, the speaker 84 may begin to output certain audio signals when the respective disc-shape page has been turned a sufficient distance or oriented such that the entire circular planar page surface is viewable.

The common story or character associated with the toy may be continually evolving or changing such as through a series of outputs through which it becomes desirable for the child to view and/or listen to new graphics, video and/or audio that corresponds to the progressing story. Therefore, circuitry 81 may include a wireless transmitter and receiver. Circuitry 81 and memory 83 may be accessed through a wireless network by another local computer device that has a transmitter and receiver such as a mobile phone, electronic tablet, or computer operated by a parent or custodian of the child. The local computer device may be able to access an Internet marketplace such as an app store through a local wireless network and download data that corresponds to the successive portions of the progressive story line. The local computer device may operate to send the newly downloaded data through a local wireless network to circuitry 81. The downloaded data may be stored on the memory 83. The memory 83 may be accessed by the other local device to add, remove, or overwrite data on the memory. The downloadable data and or audio may correspond to the common story, the common character, or the overall theme of the toy 10. Alternatively, in some exemplary embodiments the data selectively loaded to the memory may be used to change the theme or story that is output by the toy.

Again, referring to FIG. 18, in alternative exemplary embodiments, the cavity 52 may include one or more light emitters 55, a rechargeable battery 80, circuitry 81 that includes a memory 83, and wiring 82. The light emitter or emitters may be alternatively referred to herein as a light. Wiring 82 may be operatively connected to the rechargeable battery 80, circuitry 81 that includes memory 83 in the cavity and extend from the cavity 52 through the channel 53 to the light emitter 55 on the round outer surface 16, 18 of a respective end cover 12, 14. Memory 83 may store data for different types, sequences and colors of light outputs that comprise light shows corresponding to a common story, a common character, or an overall theme of the toy 10.

In some exemplary embodiments, the plurality of disc-shape pages may include motion sensors or orientation sensors that cause a light show to be output through the at least one light emitter 55. The motion or orientation sensors may be in wired or wireless communication with circuitry 81 that is wired to the at least one light emitter 55 to cause display of the light shows at the appropriate times. For example, the light emitter 55 may begin to display a certain light show when the respective disc-shape page has been turned a sufficient distance or oriented such that generally the entire circular planar page surface 26, 28 is viewable.

The story or character may be continually evolving such as via a progressing series or story line in which it becomes desirable to obtain new light shows to correspond to the evolving story line. Therefore, circuitry 81 may include a wireless transmitter and receiver. Circuitry 81 and memory 83 may be accessed through a local wireless connection by another local computer device with a transmitter and receiver such as a mobile phone, electronic tablet, or computer. The local computer device may be operated by a parent or custodian to selectively access an Internet marketplace such as an app store through a local wireless network and download data that is operative to cause the output of different light shows or other output content. The other local device may be able to send the downloaded data for different light shows or other content through a local wireless connection to circuitry 81. The downloaded data for different light shows or other content may be stored on the memory 83. The memory 83 may be accessed by the local computer device to add, remove, or overwrite data on the memory. The downloadable data for the different light shows or other content may correspond to the development of the common story, the common character, or the overall theme of the toy 10. The light show, in some exemplary arrangements, may be coordinated with data that corresponds to visual outputs and audio outputs from the toy. In other exemplary arrangements, the light shows may be output responsive to selected inputs to input devices of the toy. The input devices may include sensors such as accelerometers, compression sensors, motion sensors, orientation sensors, audio sensors or other sensor that detect conditions or other inputs and cause light show outputs in response thereto.

Figure 21:
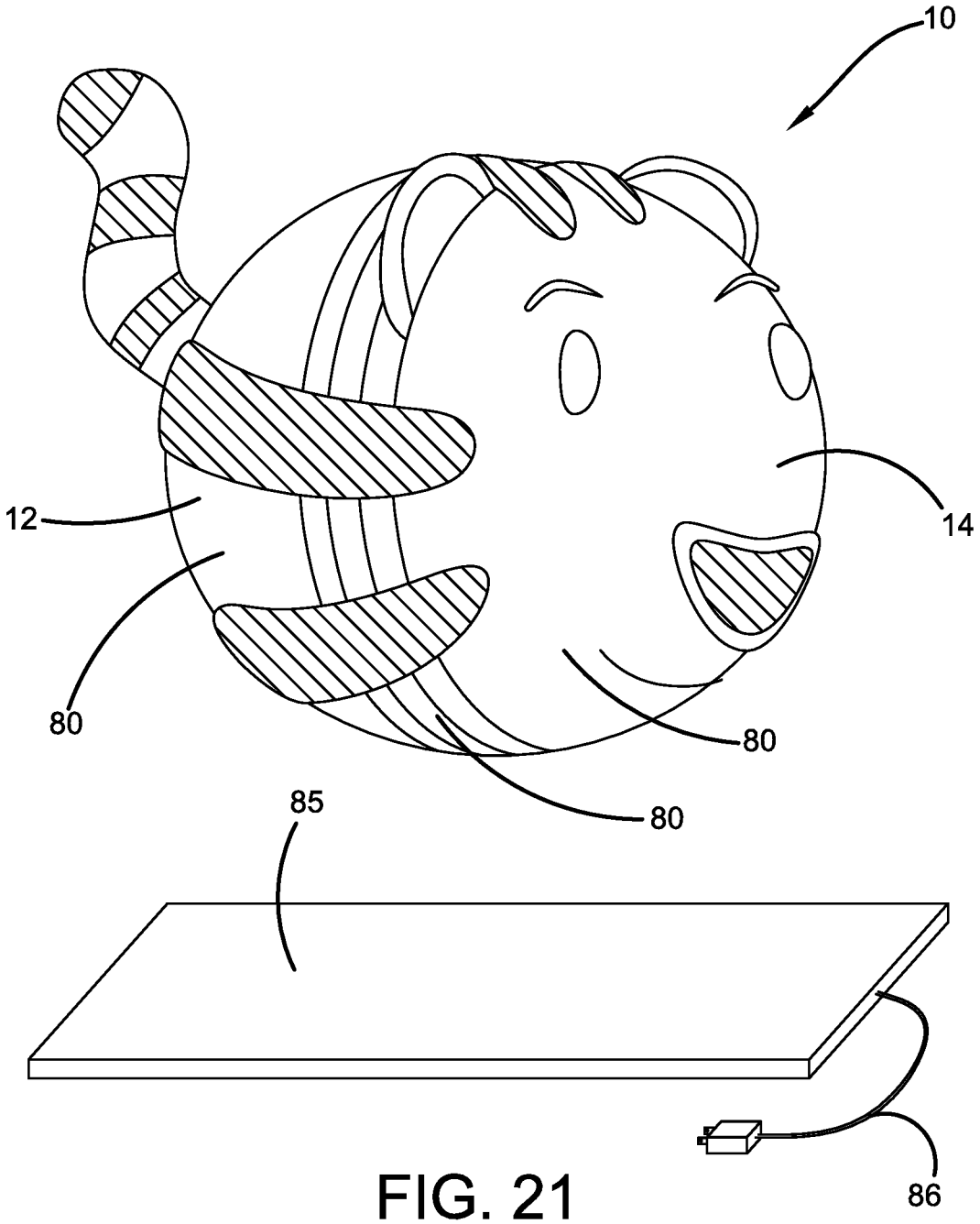
FIG. 21 is a perspective view of an exemplary toy having an exemplary detached wireless charging pad.

As shown in FIG. 21, in alternative exemplary embodiments the exemplary toy 10 may be associated with a detached charging pad 85. The charging pad 85 may be any type of suitable wireless charger. For example, the charging pad 85 may be a wireless induction charger. The toy may include suitable circuitry to receive energy from the charging pad. The toy 10 may be placed on the charging pad 85 to recharge the at least one battery 80 which is located in one or both of the end covers 12, 14 or in one or more of the plurality of disc-shape pages 24. The charging pad 85 allows the battery 80 of the toy 10 to be recharged without accessing the interior of the toy 10 to access or change the at least one battery 80. The charging pad 85 in some exemplary embodiments is capable of charging multiple batteries at once. Therefore, in exemplary embodiments that have a screen 79, the noise maker 54, and the at least one light emitter 55, and associated circuitry, each of the respective batteries associated with each device may be charged simultaneously. Charging pad 85 may include a power cord 86. Power cord 86 may be plugged into a household outlet or other local power source such as a power source inside of a car.

While the exemplary features have been shown and described with reference to certain embodiments thereof, it will be understood by those skilled in the art that the foregoing and other modifications or changes in form and details may be made therein without departing from the spirit and scope of the exemplary embodiments as claimed.

It should be mentioned that while the exemplary embodiments herein have been described with regard to certain elements, other elements may be used in other embodiments and the functionality and embodiment achieved by a single element as described herein in connection with an embodiment may be carried out through the combination of multiple elements in other embodiments. Likewise, the functions and embodiments achieved by multiple elements as described herein may be achieved in other arrangements by a single element. Further, while examples have been provided for purposes of explanation, it is to be understood that these are exemplary embodiments and are not to be construed as limiting the hereto appended claims. Additionally, it should be recognized that the examples provided herein may be modified or permutated while still falling within the scope of the claims.

Thus, the exemplary embodiments achieve new and improved functionality, eliminate difficulties encountered in the prior art, and attain the useful results described herein.

In the foregoing description, certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the inventive aspects are not limited solely to the features shown and described.

Further, in the following claims any feature described as a means for performing a function shall be construed as encompassing any means known to those skilled in the art as being capable of carrying out the recited function, and shall not be deemed limited to the particular means shown or described for performing the recited function in the foregoing description, or mere equivalents thereof.

Having described the features, discoveries, and principles of the exemplary embodiments, the manner in which they are constructed and operated, and the advantages and useful results attained; the new and useful structures, elements, arrangements, parts, combinations, and relationships are set forth in the appended claims.

I claim:

1. Apparatus comprising:

a child toy configured to be transformed between a book and a ball, wherein the toy includes a pair of end covers, wherein each of the pair of end covers has a respective round outer surface and a planar inner surface, a plurality of disc-shape pages, wherein each disc-shape page includes a first circular planar page surface, an opposed second circular planar page surface, and a circular peripheral surface that bounds the respective page and extends transversely between the first circular planar page surface and the second circular planar page surface, at least one flexible hinge, wherein the at least one flexible hinge is in operative connection with each of the plurality of disc-shape pages and each of the pair of end covers, wherein the pair of end covers and the plurality of disc-shape pages are movable in operative engagement with the at least one flexible hinge between a ball position and a book position, wherein in the ball position the planar inner surfaces of each of the pair of end covers are in opposed facing relation, and the plurality of disc-shape pages are in parallel abutting sandwiched relation between the planar inner surfaces of the pair of end covers, and the circular peripheral surface of each page is externally exposed, wherein in the book position the planar inner surfaces of each of the pair of end covers are disposed away from one another, and each of the plurality of disc-shape pages are individually movable in operative engagement with the at least one flexible hinge such that the first and second circular planar page surfaces of each disc-shape page are individually viewable.

2. The apparatus according to claim 1 wherein the at least one flexible hinge is in operative connection with the round outer surface of each respective end cover, and wherein the at least one flexible hinge is in attached connection with the circular peripheral surface of each respective disc-shape page, wherein in the ball position of the pair of end covers, the at least one flexible hinge conforms to the round outer surface of each of the pair of end covers and the circular peripheral surface of each of the plurality of disc-shape pages.

3. The apparatus according to claim 1 wherein the circular peripheral surface of each disc-shape page includes a point of attachment, wherein each of the plurality of disc-shape pages is operatively in attached connection with the at least one flexible hinge at the respective point of attachment.

4. The apparatus according to claim 3 wherein each of the plurality of disc-shape pages has a page thickness, wherein the page thickness extends transversely between the first circular planar page surface and the second circular planar page surface, and wherein the point of attachment of a respective disc-shape page is separated from the point of attachment of an immediately adjacent disc-shape page by a distance, wherein the distance is greater than the page thickness, whereby when the pair of end covers are in the book position the plurality of disc-shape pages are movable without interference from the immediately adjacent disc-shape pages.

5. The apparatus according to claim 4 wherein the round outer surface of each of the pair of end covers includes an end cover point of attachment, wherein each of the pair of end covers is operatively connected to the at least one flexible hinge at the end cover point of attachment, wherein the end cover point of attachment of each end cover is separated from the point of attachment of the immediately adjacent disc-shape page by a further distance, wherein the further distance is greater than the page thickness of the disc-shape pages, whereby when the pair of end covers are in the book position each disc-shape page that is immediately adjacent to one of the pair of end covers is movable without interference from the immediately adjacent end cover.

6. The apparatus according to claim 1 and further comprising:

a releasable clasp, wherein the releasable clasp includes a first piece and a second piece, wherein the first piece and the second piece are releasably engageable with each other, wherein the first piece is in operative attachment with one of the pair of end covers and the second piece is in operative attachment with the other of the pair of end covers.

7. The apparatus according to claim 1 and further comprising:

a noise emitter and a light emitter, wherein at least one of the noise emitter and the light emitter is in operative connection with at least one of the pair of end covers.

8. The apparatus according to claim 1 and further comprising:

a display screen, wherein at least one of the plurality of disc-shape pages includes the display screen.

9. Apparatus comprising:

a child toy configured to be transformed between a book and a ball, wherein the toy includes a pair of hemispherical end covers, wherein each of the pair of hemispherical end covers has a respective round outer surface and a planar inner surface, wherein at least one of the planar inner surfaces includes viewable cover indicia, a plurality of disc-shape pages, wherein each of the plurality of disc-shape pages includes a first circular planar surface, an opposed second circular planar surface, and a circular peripheral surface that extends transversely between the first circular planar surface and the second circular planar surface, wherein at least one of the first and second circular planar surfaces of each respective disc-shape page includes viewable page indicia, a flexible hinge, wherein the flexible hinge has a concave inner peripheral surface and a convex outer peripheral surface, wherein the concave inner peripheral surface is disposed a hinge thickness from the convex outer peripheral surface, wherein each of the pair of hemispherical end covers and each of the plurality of disc shape-pages are operatively connected to the concave inner peripheral surface of the flexible hinge, wherein each of the pair of hemispherical end covers and each of the plurality of disc-shape pages are movable in operative connection with the concave inner peripheral surface of the flexible hinge between a ball position and a book position, wherein in the book position, the planar inner surfaces of each of the pair of hemispherical end covers are disposed from one another a sufficient distance such that each of the plurality of disc-shape pages are individually movable in operative connection with the concave inner peripheral surface of the flexible hinge, wherein the viewable page indicia and cover indicia are each selectively viewable, wherein in the ball position, the planar inner surfaces of each of the pair of hemispherical end covers are in opposed facing relation and the plurality of disc-shape pages are in parallel abutting sandwiched relation between the planar inner surfaces of each of the pair of hemispherical end covers, wherein in the ball position, the round outer surface of each of the pair of hemispherical end covers and the circular peripheral surface of each of the plurality of disc-shape pages comprise a continuous convex outer peripheral ball surface, wherein in the ball position the concave inner peripheral surface of the flexible hinge is in abutting overlying relation with the convex continuous outer peripheral ball surface such that the convex outer peripheral surface of the flexible hinge extends outwardly from the continuous convex outer peripheral ball surface the hinge thickness, whereby in the ball position the child toy is rollable in any direction.

10. The apparatus according to claim 9 wherein each of the plurality of disc-shape pages is operatively connected to the concave inner peripheral surface of the flexible hinge at a point of attachment on the circular peripheral surface of each respective disc-shape page.

11. The apparatus according to claim 10 wherein each of the plurality of disc-shape pages has a page thickness that extends transversely between the first circular planar surface and the second circular planar surface, and wherein the points of attachment are separated by a distance, wherein the distance is greater than the page thickness, whereby when the pair of end covers are in the book position each of the plurality of disc-shape pages is movable without interference from the immediately adjacent disc-shape pages.

12. The apparatus according to claim 11 wherein the flexible hinge is circular, wherein each of the pair of hemispherical end covers is operatively connected to the concave inner peripheral surface of the circular flexible hinge at an end cover point of attachment on the round outer surface of each respective hemispherical end cover, wherein each end cover point of attachment is separated from an immediately adjacent disc-shape page by a further distance, wherein the further distance is greater than the page thickness, whereby when the pair of end covers are in the book position the disc-shape page immediately adjacent to a respective hemispherical end cover is movable without interference from the immediately adjacent hemispherical end cover.

13. The apparatus according to claim 12 further including a releasable clasp, wherein the releasable clasp is attached to each of the pair of hemispherical end covers and includes a first piece and a second piece, wherein the first piece and the second piece are releasably engageable, and wherein the first piece is in operative attachment with one of the pair of hemispherical end covers and the second piece is in operative attachment with the other of the pair of hemispherical end covers.

14. Apparatus comprising:

a child toy configured to be transformed between a book and a ball, wherein the toy includes a pair of end covers, wherein at least one of the end covers includes a cavity, wherein the cavity includes a cavity interior, a plurality of pages, wherein each of the plurality of pages includes a first planar page surface, an opposed second planar page surface and a peripheral surface that bounds the respective page and extends transversely between the first planar page surface and the second planar page surface, at least one flexible hinge, wherein the at least one flexible hinge is in operative engagement with each of the plurality of pages and each of the pair of end covers, wherein one of the pair of end covers includes a noise emitter, wherein the noise emitter is within the cavity interior of the respective end cover, wherein each of the pair of end covers are movable in operative engagement with the at least one flexible hinge between an open position and a closed position, wherein in the closed position, the end covers are in opposed relation, the plurality of pages are in parallel abutting sandwiched relation between the end covers, and the external peripheral surfaces of each page are externally exposed, wherein in the open position, the pair of end covers are disposed from one another a sufficient distance such that each of the plurality of pages are individually movable, whereby the first and second planar page surfaces of each of the pages are each individually viewable, wherein in the closed position of the end covers, the end covers and the peripheral surfaces of the plurality of pages sandwiched therebetween define a ball shape, whereby the child toy is rollable in any direction.

15. The apparatus according to claim 14 wherein each of the pair of end covers includes a cover outer round surface and a cover inner planar surface, wherein in the closed position, the cover inner planar surfaces are in facing, parallel relation.

16. Apparatus comprising:

a child toy configured to be transformed between a book and a ball, wherein the toy includes a pair of end covers, wherein each of the pair of end covers has a respective round outer surface and a planar inner surface, a plurality of disc-shape pages, wherein each disc-shape page includes a first circular planar page surface and an opposed second circular planar page surface, and a circular peripheral surface, at least one flexible hinge, wherein the at least one flexible hinge is circular and includes a concave inner peripheral surface and a convex outer peripheral surface, wherein the concave inner peripheral surface and the convex outer peripheral surface are separated by a hinge thickness, is in operative connection with each of the plurality of disc-shape pages and each of the pair of end covers, wherein the pair of end covers and each of the plurality of disc-shape pages are movable in operative engagement with the at least one flexible hinge between a ball position and a book position, wherein in the ball position the planar inner surfaces of each of the pair of end covers are in opposed facing relation, the plurality of disc-shape pages are in parallel abutting sandwiched relation between the planar inner surfaces of the pair of end covers, the round outer surface of each of the pair of end covers and the circular peripheral surfaces of the plurality of disc-shape pages form an externally exposed convex outer peripheral ball surface, the concave inner peripheral surface of the at least one hinge extends in abutting overlying relation of the convex outer peripheral ball surface, and the convex outer peripheral surface of the at least one hinge extends outwardly from the convex outer peripheral ball surface the thickness of the at least one hinge, wherein in the book position the planar inner surfaces of each of the pair of end covers are disposed away from one another, and each of the plurality of disc-shape pages are individually movable in operative engagement with the at least one hinge such that the first and second circular planar page surfaces of each disc-shape page are individually viewable.

17. The apparatus according to claim 16 and further comprising:

a display screen, wherein at least one of the plurality of disc-shape pages includes the display screen.

18. The apparatus according to claim 16 wherein at least one of the circular peripheral surfaces or at least one of the circular planar page surfaces of at least one of the plurality of disc-shape pages includes at least one of a zipper, a pair of hook and loop structures, a piece including a button and a piece including a hole, a pair of tieable laces, or a releasably engageable first snap piece and second snap piece.

19. The apparatus according to claim 16 wherein the toy further includes circuitry, wherein the circuitry includes a memory, at least one sensor and at least one of a noise emitter and a light emitter, wherein the at least one sensor and the at least one of the noise emitter and the light emitter are in operative connection with the circuitry, wherein the circuitry is operative to cause at least one output from at least one of the noise emitter and the light emitter responsive at least in part to the at least one sensor detecting at least one condition, wherein the at least one sensor comprises at least one of an accelerometer, a compression sensor, a motion sensor, and an orientation sensor.

20. The apparatus according to claim 19 wherein the toy further includes a battery, wherein the battery is in operative connection with the circuitry, wherein the circuitry is operative to cause the battery to be wirelessly charged, whereby the circuitry is operative to cause the battery to be wirelessly charged when the toy is positioned in operative connection with a charging pad.

21. Apparatus comprising:

a child toy configured to be transformed between a book and a ball, wherein the toy includes a pair of end covers, wherein each of the pair of end covers has a respective round outer surface and a planar inner surface, a plurality of disc-shape pages, wherein each disc-shape page includes a first circular planar page surface, an opposed second circular planar page surface, and a bounding peripheral surface extending transversely between the first circular planar page surface and the second circular planar page surface, wherein each disc-shape page is in movable operatively engaged connection with at least one immediately adjacent disc-shape page, and wherein each disc-shape page immediately adjacent to one of the pair of end covers is in movable operatively engaged connection with the immediately adjacent end cover, wherein the pair of end covers and the plurality of disc-shape pages are movable between a ball position and a book position, wherein in the ball position, the planar inner surfaces of each of the pair of end covers are in opposed facing relation, and the plurality of disc-shape pages are in parallel abutting sandwiched relation between the planar inner surfaces of the pair of end covers, and the bounding peripheral surfaces of the disc-shape pages are externally exposed, wherein in the book position, at least a portion of the respective planar inner surface of one of the pair of end covers is movable further away from the respective planar inner surface of the other of the pair of end covers than when the end coves are in the ball position, wherein each of the planar surfaces of each end cover are individually viewable, and each of the plurality of disc-shape pages are individually movable wherein the first and second circular planar page surfaces of each disc-shape page are individually viewable.

22. Apparatus comprising:

a child toy configured to be transformed between a book and a ball, wherein the toy includes a pair of end covers, wherein each of the pair of end covers has a respective round outer surface and a planar inner surface, a plurality of disc-shape pages, wherein each disc-shape page includes a first circular planar page surface and an opposed second circular planar page surface, each disc-shape page is bounded by a peripheral surface that extends transversely between the first circular planar page surface and the second circular planar page surface, each disc-shape page is in movable operative connection with each immediately adjacent disc-shape page, and each disc-shape page immediately adjacent to one of the pair of end covers is in movable operative connection with the immediately adjacent end cover, wherein the pair of end covers and the plurality of disc-shape pages are movable between a ball position and a book position, wherein in the ball position, the planar inner surfaces of each of the pair of end covers are in opposed facing relation, the plurality of disc-shape pages are in parallel abutting sandwiched relation between the planar inner surfaces of the pair of end covers, and the peripheral surface of each of the respective disc-shape pages is externally exposed and extends continuously with the round outer surface of each of the end covers, wherein in the book position, the planar inner surfaces of each of the pair of end covers are disposed away from one another such that the respective planar inner surfaces are each individually viewable, and each of the plurality of disc-shape pages are individually movable such that the respective first and second circular planar page surfaces of each disc-shape page are individually viewable.

23. Apparatus comprising:

a child toy configured to be transformed between a book and a ball, wherein the toy includes a pair of end covers, wherein each of the pair of end covers has a respective round outer surface and a planar inner surface, a plurality of disc-shape pages, wherein each disc-shape page includes a first circular planar page surface, an opposed second circular planar page surface, and a bounding peripheral surface that extends transversely between the first circular planar page surface and the second circular planar page surface, wherein each disc-shape page is in movable operative connection with each immediately adjacent disc-shape page, and wherein each disc-shape page that is immediately adjacent to a respective end cover is in movable attached connection with the immediately adjacent end cover, wherein the pair of end covers and the plurality of disc-shape pages are movable between a ball position and book position, wherein in the ball position, the planar inner surfaces of each of the pair of end covers are in opposed facing relation, and the plurality of disc-shape pages are in parallel abutting sandwiched relation between the planar inner surfaces of the pair of end covers and each of bounding peripheral surfaces of the disc shape pages are externally exposed such that end covers are maintained apart by the disc-shape pages extending therebetween, wherein in the book position, the planar inner surfaces of each of the pair of end covers are disposed away from one another such that the respective planar inner surfaces are each individually viewable, and each of the plurality of disc-shape pages are individually movable such that the respective first and second circular planar page surfaces of each disc-shape page are individually viewable.

24. Apparatus comprising:

a child toy configured to be transformed between a book and a ball, wherein the toy includes a pair of end covers, wherein each of the pair of end covers has a respective planar inner surface and a respective outer bounding surface, wherein at least one of the planar inner surfaces includes viewable cover indicia, wherein each respective outer bounding surface extends transversely away from the respective inner surface, wherein each respective planar inner surface is bounded by a respective peripheral edge, wherein the respective peripheral edge has a common bounding contour, a plurality of pages, wherein each of the plurality of pages includes a first planar surface, an opposed second planar surface, and a peripheral surface, wherein the peripheral surface extends transversely between the first planar surface and the second planar surface of the respective page, and has the common bounding contour, wherein at least one of the first and second planar surfaces of each respective page includes viewable page indicia, wherein each of the pair of end covers and each of the plurality of pages are in relatively movable continuously joined operative connection, wherein each of the pair of end covers and each of the plurality of pages are movable between a ball position and a book position, wherein in the book position, the planar inner surfaces of each of the pair of end covers are disposed from one another a sufficient distance such that the plurality of pages are individually movable and the viewable page indicia and the cover indicia are each selectively viewable, and wherein in the ball position, the planar inner surfaces of each of the pair of end covers are in opposed facing relation and the plurality of pages are in parallel abutting sandwiched relation between the planar inner surfaces of each of the pair of end covers, and the outer bounding surface of each of the pair of end covers and the peripheral surface of each of the plurality of pages are each a part of an outer peripheral ball surface.

25. The apparatus according to claim 5 and further comprising:

a releasable clasp, wherein the releasable clasp includes a first piece and a second piece, wherein the first piece and the second piece are releasably engageable with each other, wherein the first piece is in operative attachment with one of the pair of end covers and the second piece is in operative attachment with the other of the pair of end covers.

26. The apparatus according to claim 25 wherein the first piece and the second piece of the releasable clasp comprise at least one of a pair of hook and loop structures, a pair of tieable laces, a button piece including a button and a hole piece including a hole, or a releasably engageable first snap piece and second snap piece.

27. The apparatus according to claim 26 and further comprising:

a noise emitter, wherein the noise emitter is in operative connection with at least one of the pair of end covers.

28. The apparatus according to claim 27 wherein at least one of the pair of end covers includes a cavity and a channel, wherein the cavity is enclosed within the at least one end cover and includes a cavity interior therein, and wherein the channel extends from the cavity interior to the round outer surface of the at least one end cover, wherein the cavity interior includes a battery, and circuitry, wherein the circuitry includes a memory, wherein the channel includes wiring, wherein the wiring is in operative connection with the battery and the circuitry, and wherein the wiring extends through the channel and is in operative connection with at least one of a light emitter or noise emitter exposed on the round outer surface of the at least one end cover.

29. The apparatus according to claim 28 and further comprising:

a teething ring, wherein the teething ring is in operative attachment with at least one of the pair of end covers.

30. The apparatus according to claim 29 and further comprising:

a plurality of outward extending projections, wherein at least one of the pair of end covers includes the outward extending projections, and wherein the outward extending projections comprise at least one of an animal appearance feature, a sports ball appearance feature, or a human appearance feature.

31. The apparatus according to claim 30 wherein the child toy comprises at least one of a soft, plush material, waterproof material, and buoyant material.

32. The apparatus according to claim 31 wherein in the ball position, the pair of end covers and the plurality of pages define a shape of the toy, wherein the shape includes at least one of a spherical shape, an egg shape, or a three dimensional oval shape.

* * * * *